US011280301B2

(12) United States Patent
Hamazume et al.

(10) Patent No.: US 11,280,301 B2
(45) Date of Patent: Mar. 22, 2022

(54) INTAKE DEVICE OF ENGINE

(71) Applicant: MAZDA MOTOR CORPORATION, Hiroshima (JP)

(72) Inventors: Yoshihiro Hamazume, Aki-gun (JP); Takashi Yoshikawa, Aki-gun (JP); Jiro Kato, Aki-gun (JP); Taketoshi Yamauchi, Aki-gun (JP); Hirofumi Shinohara, Aki-gun (JP); Kazuhiro Nakamura, Aki-gun (JP); Yoko Inami, Aki-gun (JP); Shouichi Aiga, Aki-gun (JP); Tomoaki Fujiyama, Aki-gun (JP); Kosuke Miyamoto, Aki-gun (JP); Takuya Yamada, Aki-gun (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/093,320

(22) Filed: Nov. 9, 2020

(65) Prior Publication Data

US 2021/0222653 A1 Jul. 22, 2021

(30) Foreign Application Priority Data

Jan. 20, 2020 (JP) ..... JP2020-006826
May 20, 2020 (JP) ..... JP2020-087809

(51) Int. Cl.
*F02M 35/10* (2006.01)
*F02M 26/13* (2016.01)
*F02M 31/20* (2006.01)

(52) U.S. Cl.
CPC ..... *F02M 35/10222* (2013.01); *F02M 26/13* (2016.02); *F02M 31/20* (2013.01); *F02M 35/10262* (2013.01)

(58) Field of Classification Search
CPC ..... F02M 35/10222; F02M 35/10262; F02M 26/13; F02M 31/20
(Continued)

(56) References Cited

U.S. PATENT DOCUMENTS

2010/0077996 A1* 4/2010 Pantow ..... F02M 35/112 123/557
2011/0088663 A1* 4/2011 Dehnen ..... F02B 29/0462 123/542
(Continued)

FOREIGN PATENT DOCUMENTS

JP 2015124687 A 7/2015

*Primary Examiner* — Mahmoud Gimie
(74) *Attorney, Agent, or Firm* — Studebaker & Brackett PC

(57) ABSTRACT

An intake device of an engine comprises an intercooler, an intake passage including a downstream-side intake passage, and an EGR passage recirculating exhaust gas to the downstream-side intake passage. An intake-air supply opening having an opening area smaller than an area of a downstream-side face of an intercooler core is provided at a downstream side wall of a chamber. The downstream-side intake passage includes an extension passage portion extending upwardly along the downstream side wall. The intake-air supply opening includes an upper edge portion which separates the intake air flowing from an inside wall face of the extension passage portion and forms flowing main streams of the intake air inside the extension passage portion. EGR introduction ports are arranged at positions capable of supplying the EGR gas toward the flowing main streams.

18 Claims, 25 Drawing Sheets

(58) Field of Classification Search
USPC ..... 123/568.11
See application file for complete search history.

(56) References Cited

U.S. PATENT DOCUMENTS

| | | | | |
|---|---|---|---|---|
| 2013/0081601 | A1* | 4/2013 | Martins | F02M 26/10 123/568.12 |
| 2015/0184581 | A1 | 7/2015 | Nakasugi et al. | |

* cited by examiner

INTAKE DEVICE OF ENGINE

BACKGROUND OF THE INVENTION

The present invention relates to an intake device of an engine which is configured such that an intercooler is provided in a middle of an intake passage and a part of exhaust gas is recirculated into the intake passage from an EGR passage.

The intake device of the engine which comprises the intercooler to cool intake air supplied into an engine body and an EGR device to recirculate a part of the exhaust gas is well known. Japanese Patent Laid-Open Publication No. 2015-124687 (US 2015/0184581 A1), for example, discloses an intake device which is configured such that a chamber which stores an intercooler core therein is arranged in a middle of an intake passage and an EGR passage through which a part of the exhaust gas is recirculated as EGR gas is connected to a portion of the intake passage which is positioned downstream of the chamber.

In the intake device disclosed in the above-described patent document, a chamber outlet through which the intake air is supplied to the downstream portion of the intake passage from the chamber is configured to be opened widely (see FIG. 6 in the patent document). Accordingly, since the intake air which has passed through the intercooler core flows down to the downstream portion of the intake passage randomly, there occurs a tendency that flowing of the intake air becomes irregular. Specifically, a part of the intake air passing at an upper side of the chamber interferes with another part of the intake air passing at a lower side of the chamber, so that there may occur a case where any intended (desired) intake-air flowing is not formed. In this case, mixing of the EGR gas with the intake air becomes so insufficient that there may happen a problem that the EGR gas is not evenly distributed to plural cylinders of the engine.

SUMMARY OF THE INVENTION

An object of the present invention is to provide an intake device of an engine which can properly mix the EGR gas with the intake air passing through the intercooler.

A first aspect of the present invention is an intake device of an engine, comprising an intercooler including a chamber and an intercooler core stored inside the chamber, an intake passage including a downstream-side intake passage positioned downstream of the chamber of the intercooler and provided to introduce intake air into an engine body through the chamber, and an EGR passage provided to recirculate a part of exhaust gas exhausted from the engine body to the downstream-side intake passage of the intake passage as EGR gas, wherein the chamber includes a side wall provided with an intake-air supply opening which has an opening area which is smaller than an area of a downstream-side face of the intercooler core, the downstream-side intake passage includes an upstream end which is connected to the intake-air supply opening and an extension passage portion which extends upwardly from the upstream end along the side wall of the chamber, the extension passage portion being partitioned by a wall which includes an inside wall part positioned on a side of the chamber and an outside wall part facing the inside wall part, an opening edge which partitions the intake-air supply opening includes an upper edge portion which is configured to separate the intake air flowing from the chamber into the extension passage portion from the inside wall part and to form a main stream of flowing of the intake air inside the extension passage portion, and the outside wall part of the extension passage portion includes an EGR introduction port to join the EGR passage to the downstream-side intake passage, the EGR introduction port being arranged at a position capable of supplying the EGR gas toward the main stream of flowing of the intake air.

According to the first aspect of the present invention, since the chamber has the intake-air supply opening having the opening area which is smaller than the area of the downstream-side face of the intercooler core, the intake air can be supplied out of the intake-air supply opening substantially in a collective state. Therefore, it can be prevented that the intake air which has passed through the intercooler core flows into the downstream-side intake passage disorderly. Further, since the intake air is introduced into the downstream-side intake passage through the intake-air supply opening partitioned by the opening edge having the above-described upper edge portion, the main stream of flowing of the intake air which flows down in the vicinity of the outside wall part of the extension passage portion is generated. Herein, since the above-described extension passage portion extends upwardly along the chamber from the upstream end which is connected to the intake-air supply opening of the side wall of the chamber, the above-described main stream of flowing of the intake air becomes flowing which goes up along the outside wall part with a secondary flow which swirls. Moreover, the EGR introduction port is arranged at the outside wall part so that the EGR gas can be supplied toward the main stream of flowing of the intake air. Thereby, the EGR gas discharged (supplied) from the EGR introduction port hits against the above-described main stream of flowing of the intake air going up swirling, so that the EGR gas can be properly mixed with the intake air.

In an embodiment of the present invention, the opening edge of the intake-air supply opening comprises a straight edge portion which corresponds to the upper edge portion and a semicircular edge portion which is positioned below the straight edge portion.

According to this embodiment, since the upper edge portion is configured to be the straight edge portion, the intake air can be easily separated from a surface of the inside wall part. Further, since the semicircular edge portion is provided, the main stream of flowing of the intake air going up swirling can be easily generated.

In another embodiment of the present invention, an upstream part of the extension passage portion which is continuous to the upstream end is a curved passage which is configured to be curved upwardly, the upstream part being of a semicircular shape, in a sectional view, similarly to the intake-air supply opening.

According to this embodiment, the main stream of flowing of the intake air going up swirling (the secondary flow) can be properly maintained.

In another embodiment of the present invention, the intake-air supply opening is arranged in a lower-end area of the chamber.

According to this embodiment, the length of the extension passage portion extending upwardly along the chamber can be made properly long. Thereby, the mixing time of the EGR gas with the intake air is made so long that the EGR gas can be evenly mixed with intake air.

In another embodiment of the present invention, the EGR introduction port is arranged in a lower-end area of the extension passage portion.

According to this embodiment, the length of the extension passage portion downstream of the EGR introduction port can be made properly long. Thereby, the mixing time of the EGR gas with the intake air is made so long that the EGR gas can be evenly mixed with intake air.

In another embodiment of the present invention, the EGR introduction port is arranged in an area except a center line, in a width direction, of the outside wall part and the vicinity thereof.

The main stream of flowing of the intake air with the secondary flow (swirling) is generated at two separated points, in a width direction, inside the extension passage portion. According to this embodiment, the EGR introduction port can be securely directed to the above-described main stream of flowing.

In another embodiment of the present invention, the EGR passage extends in a vertical direction along the outside wall part and has a forked downstream end where a lower end thereof forks, and the EGR introduction port is arranged at each of forked parts of the forked downstream end of the EGR passage.

According to this embodiment, the EGR gas discharged from a pair of EGR introduction ports arranged at the forked parts of the forked downstream end of the EGR passage can be securely made to hit against a pair of main streams of flowing generated inside the extension passage portion.

In another embodiment of the present invention, a sectional area of the EGR passage is set to be smaller than that of the extension passage portion.

According to this embodiment, the flowing of the EGR gas can be easily regulated. Thereby, the EGR gas can be easily made to hit against the main streams of flowing generated inside the extension passage portion.

In another embodiment of the present invention, the EGR passage includes a connected passage portion which is connected to the downstream-side intake passage and a separated passage portion which is arranged at a position separated from the downstream-side intake passage, and the separated passage portion is provided with a heat reception part which receives heat generated by the intercooler core.

According to this embodiment, since the heat reception part receives the heat generated by the intercooler core, the EGR gas flowing through the EGR passage can be heated. When the EGR gas is introduced into the downstream-side intake passage in a state where the EGR gas is cooled by an EGR cooler or the like, a large amount of condensed water is possibly generated. Accordingly, the condensed water can be suppressed from being generated by introducing the EGR gas which has been heated by passing through the heat reception part into the downstream-side intake passage.

In another embodiment of the present invention, the heat reception part is formed by a curved portion of a part of the separated passage portion which is configured to be curved toward the intercooler core.

According to this embodiment, since the curved portion is formed, a portion near the intercooler core, i.e., the heat reception part which receives the heat from the intercooler core, can be easily constructed.

In another embodiment of the present invention, the intercooler core is arranged such that an upstream side, in a flowing direction of the intake air, thereof approaches the separated passage portion, and the heat reception part is a portion of the separated passage portion which faces the upstream side of the intercooler core.

Since the upstream side, in the flowing direction of the intake air, of the intercooler core is a portion where the heated intake air is introduced, the temperature of this place becomes easily high. According to this embodiment, since the heat reception part approaches this upstream side, in the flowing direction of the intake air, of the intercooler core, a large amount of heat can be given to the heat reception part.

A second aspect of the present invention is an intake device of an engine, comprising an intercooler including an intercooler core, an intake passage including a downstream-side intake passage positioned downstream of the intercooler and provided to introduce intake air into an engine body through the intercooler, an EGR passage provided to recirculate a part of exhaust gas exhausted from the engine body to the downstream-side intake passage of the intake passage as EGR gas, and a housing provided with an intake-air supply opening which has an opening area which is smaller than an area of a downstream-side face of the intercooler core, wherein the downstream-side intake passage includes an upstream end which is connected to the intake-air supply opening and an extension passage portion which extends upwardly from the upstream end along the intercooler, the extension passage portion being partitioned by a wall which includes an inside wall part positioned on a side of the intercooler and an outside wall part facing the inside wall part, an opening edge which partitions the intake-air supply opening includes an upper edge portion which is configured to separate the intake air flowing from the intercooler core into the extension passage portion from the inside wall part and to form a main stream of flowing of the intake air inside the extension passage portion, and the outside wall part of the extension passage portion includes an EGR introduction port to join the EGR passage to the downstream-side intake passage, the EGR introduction port being arranged at a position capable of supplying the EGR gas toward the main stream of flowing of the intake air.

According to the second aspect of the present invention, since the housing has the intake-air supply opening having the opening area which is smaller than the area of the downstream-side face of the intercooler core, the intake air can be supplied out of the intake-air supply opening substantially in the collective state. Therefore, it can be prevented that the intake air which has passed through the intercooler core flows into the downstream-side intake passage disorderly. Further, since the intake air is introduced into the downstream-side intake passage through the intake-air supply opening partitioned by the opening edge having the above-described upper edge portion, the main stream of flowing of the intake air which flows down in the vicinity of the outside wall part of the extension passage portion is generated. Herein, since the above-described extension passage portion extends upwardly along the intercooler from the upstream end which is connected to the intake-air supply opening of the housing, the above-described main stream of flowing of the intake air becomes flowing which goes up along the outside wall part with a secondary flow which swirls. Moreover, the EGR introduction port is arranged at the outside wall part so that the EGR gas can be supplied (discharged) toward the main stream of flowing of the intake air. Thereby, the EGR gas discharged from the EGR introduction port hits against the above-described main stream of flowing of the intake air going up swirling, so that the EGR gas can be properly mixed with the intake air.

The present invention will become apparent from the following description which refers to the accompanying drawings.

DETAILED DESCRIPTION OF THE INVENTION

[Entire Structure of Engine]

Figure 1:
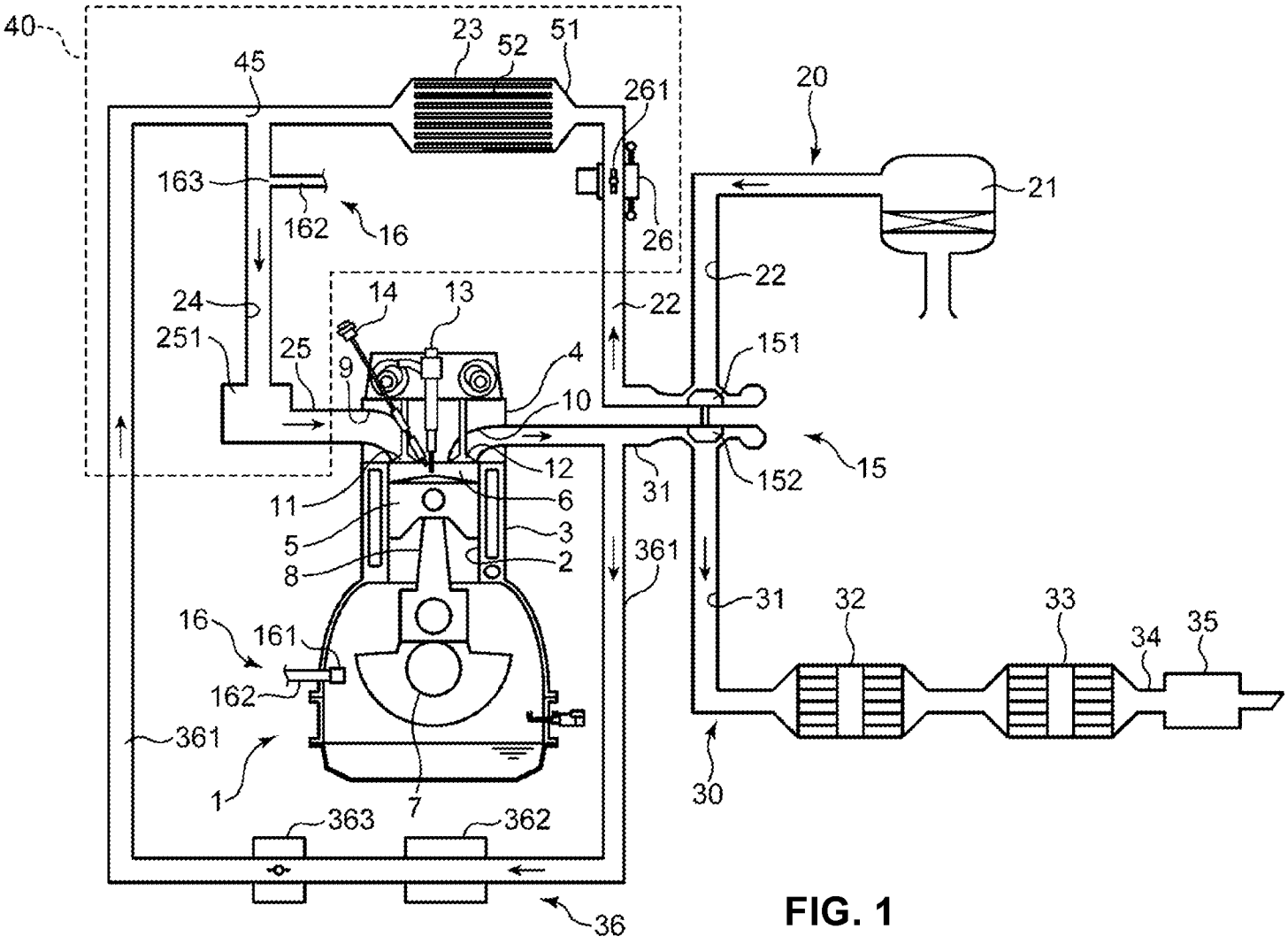
FIG. 1 is an engine system diagram of an engine to which an intake device according to an embodiment of the present invention is applied.

Hereafter, an intake device of an engine according to the present invention will be described specifically referring to the drawings. First, referring to a system diagram shown in FIG. 1, an entire structure of an engine system S to which the intake device of the engine according to the present invention is applied will be described. The engine system S shown in FIG. 1 is a four-cycle multi-cylinder gasoline engine with a turbocharger which is installed to a vehicle as a power source for driving. A driving type of the engine can be FF or FR type.

The engine system S comprises an engine body 1, an intake passage 20 which introduces outside air (intake air) into the engine body 1, an exhaust passage 30 where exhaust gas exhausted from the engine body 1 flows, an EGR device 36 which recirculates a part of the exhaust gas flowing through the exhaust passage 30 to the intake passage 20 as EGR gas, an intercooler 23 which is arranged in the intake passage 20, and a blow-by gas recirculation device 16 which recirculates blow-by gas to the intake passage 20. In the present embodiment, the intake passage 20, the intercooler 23, and the EGR device 36 constitute the intake device of the present invention.

The engine body 1 comprises a cylinder block 3 where cylinders 2 are provided, a cylinder head 4 which is attached to an upper face of the cylinder block 3, covering over the cylinders 2, a piston 5 which is stored in each of the cylinders 2. While the engine body 1 is the four-cylinder engine, for example, the single cylinder 2 is illustrated in FIG. 1 just for simplification. The piston 5 is stored inside the cylinder 2 such that it can reciprocate, having a specified stroke. A crankshaft 7 as an output shaft of the engine body 1 is provided below the piston 5. The crankshaft 7 is connected to the piston 5 via a connecting rod 8 and rotatably driven around its center axis according to reciprocating movement of the piston 5.

A combustion chamber 6 is partitioned above the piston 5. The combustion chamber 6 is partitioned by a lower surface of the cylinder head 4, the cylinder 2, and a crown surface of the piston 5. An injector 13 to inject fuel (gasoline, primarily) into the combustion chamber 6 and an ignition plug 14 to ignite mixture of the fuel injected from the injector 13 and the air introduced into the combustion chamber 6 are provided at the cylinder head 4. The mixture is combusted in the combustion chamber 6, and the piston 5 pushed down by an expansive force caused by this combustion reciprocates in a vertical direction.

An intake port 9 and an exhaust port 10 which are connected to the combustion chamber 6 are formed at the cylinder head 4. An intake-side opening which is a downstream end of the intake port 9 and an exhaust-side opening which is an upstream end of the exhaust port 10 are formed at the lower surface of the cylinder head 4. An intake valve 11 to open/close the intake-side opening and an exhaust valve 12 to open/close the exhaust-side opening are assembled to the cylinder head 4.

The intake passage 20 is a passage which is connected to each of the intake ports 9 and supplies the intake air to each of the cylinders 2 through the intercooler 23. The air taken in from an upstream end of the intake passage 20 is introduced into the combustion chamber 6 through the intake passage 20 and the intake port 9. An air cleaner 21, a turbocharger 15, a valve unit 26, and the intercooler 23 are arranged in order from an upstream side in the intake passage 20.

The air cleaner 21 purifies the intake air by removing foreign substances. The valve unit 26 includes a throttle valve 261. The throttle valve 261 performs opening/closing of the intake passage 20, linking to pressing of an accelerator, not illustrated, thereby adjusting a flow amount of the intake air flowing inside the intake passage 20. The turbocharger 15 compresses the intake air and supplies the intake air to a downstream side of the intake passage 20.

The intercooler 23 cools the intake air compressed by the turbocharger 15. The intercooler 23 is a water-cooling type, and includes a chamber 51 which is inserted into the intake passage 20 and an intercooler core 52 which is stored inside the chamber 51. The intake passage 20 comprises an upstream-side intake passage 22 which is positioned upstream of the chamber 51 and a downstream-side intake passage 24 which is positioned downstream of the chamber 51. A downstream end of the downstream-side intake passage 24 is connected to an independent intake passage 25 which is formed at an intake manifold. A surge tank 251 to provide a space for evenly distributing the intake air to the plural cylinders 2 is arranged just upstream of the independent intake passage 25.

The exhaust passage 30 is connected to the exhaust port 10 and exhausts combusted gas (exhaust gas) generated in the combustion chamber 6 to the outside of the vehicle. The exhaust passage 30 includes the upstream-side exhaust passage 31 and the downstream-side exhaust passage 34, and an upstream-side catalyst convertor 32 and a downstream-side catalyst convertor 33 are provided between the both passages 31, 34. The upstream-side catalyst convertor 32 accommodates a three-way catalyst to purify toxic components (HC, CO, NOx) contained in the exhaust gas and a GPF (Gasoline Particulate Filter) to trap particulate materials (PM) contained in the exhaust gas. The downstream-side catalyst convertor 33 accommodates proper catalysts, such as the three-way catalyst or a NOx catalyst. A silencer 35 is attached to a downstream end of the downstream-side exhaust passage 34.

The turbocharger 15 includes a compressor 151 which is arranged in the intake passage 20 and a turbine 152 which is arranged in the exhaust passage 30. The turbine 152 rotates when receiving energy of the exhaust gas flowing through the exhaust passage 30. The compressor 151 rotates, linking to the rotation of the turbine 152, so that the air flowing down in the intake passage 20 is compressed (supercharged).

The blow-by gas recirculation device 16 includes a blow-by gas inlet port 161, a blow-by gas distribution pipe 162, and a blow-by gas introduction port 163. The blow-by gas inlet port 161 takes in the blow-by gas as unburned mixture which flows out from the cylinders 2 to the outside during operation of the engine body 1. The blow-by gas distribution pipe 162 is a pipe to interconnect the blow-by gas inlet port 161 and the blow-by gas introduction port 163. The blow-by gas introduction port 163 is arranged so as to connect to an appropriate portion of the downstream-side intake passage 24, which is an opening for recirculating the blow-by gas to the downstream-side intake passage 24.

The EGR device 36 is a device to perform so-called high-pressure EGR, which includes an EGR passage 361, an EGR cooler 362, and an EGR valve 363. The EGR passage 361 interconnects the exhaust passage 30 and the intake passage 20. Specifically, this passage 361 interconnects the upstream-side exhaust passage 31 which is positioned upstream of the turbocharger 15 and the downstream-side intake passage 24 which is positioned downstream of the intercooler 23. The EGR cooler 362 cools the exhaust gas (EGR gas) recirculated from the exhaust passage 30 to the intake passage 20 through heat exchanging. The EGR valve 363 adjusts the flow amount of the exhaust gas flowing down in the EGR passage 361. Herein, the EGR gas recirculated by the EGR device 36 and the above-described blow-by gas are a kind of gas which tends to generate condensed water.

In the present embodiment, a part of an intake passage system and the intercooler 23 are integrated as an intake unit 40 (the intake device of the engine), and this intake unit 40 is attached to the engine body 1. Portions included in the intake unit 40 are a part of the upstream-side intake passage 22 which is positioned downstream of the valve unit 26, the intercooler 23, the downstream-side intake passage 24, the surge tank 251, the independent intake passage 25 as the intake manifold, a downstream part of the EGR passage 361, and the blow-by introduction port 163.

[External-Appearance Structure of Engine]

Figure 2:
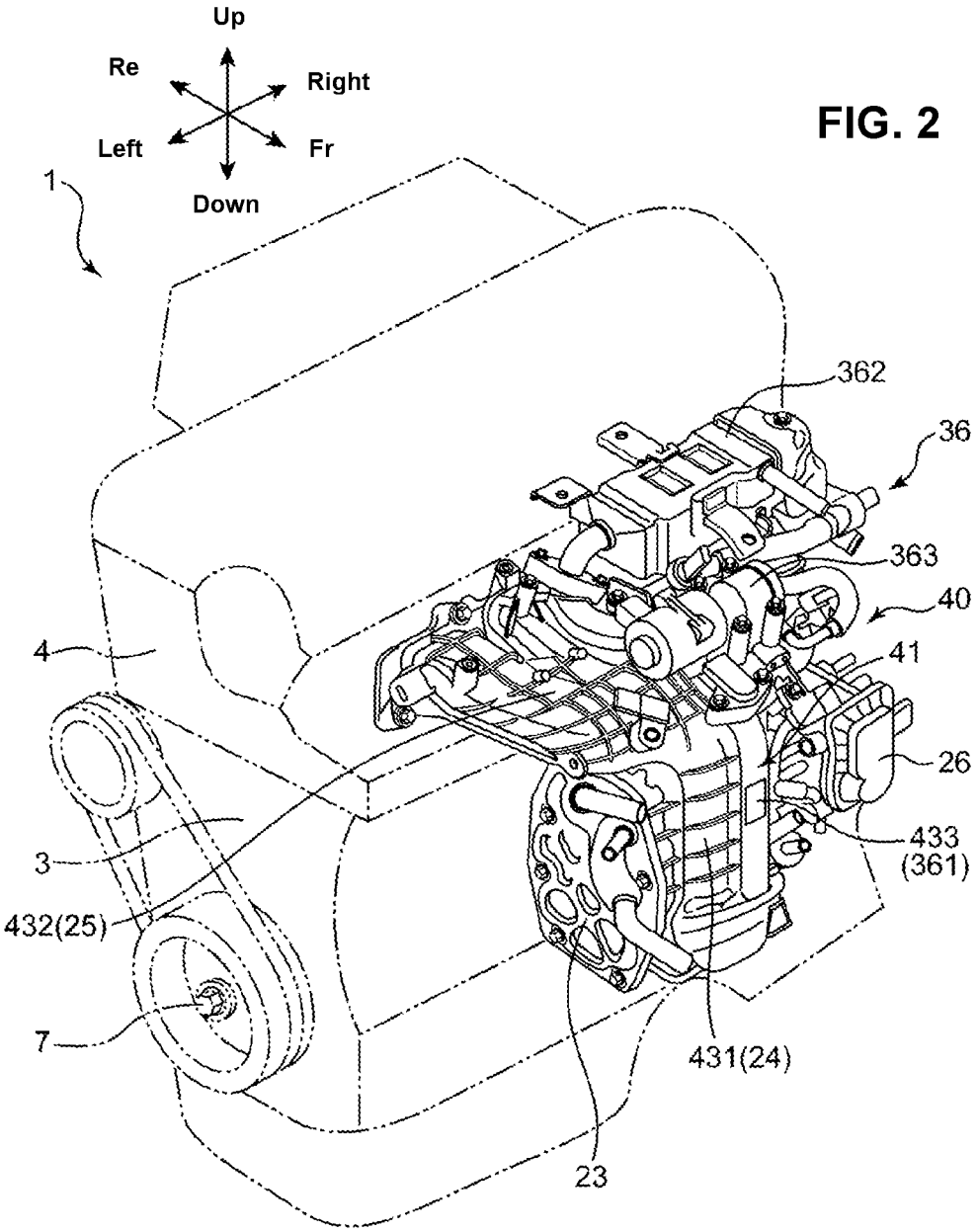
FIG. 2 is a perspective view schematically showing an external appearance of the engine to which an intake device according to a first embodiment of the present invention is applied.
Figure 3:
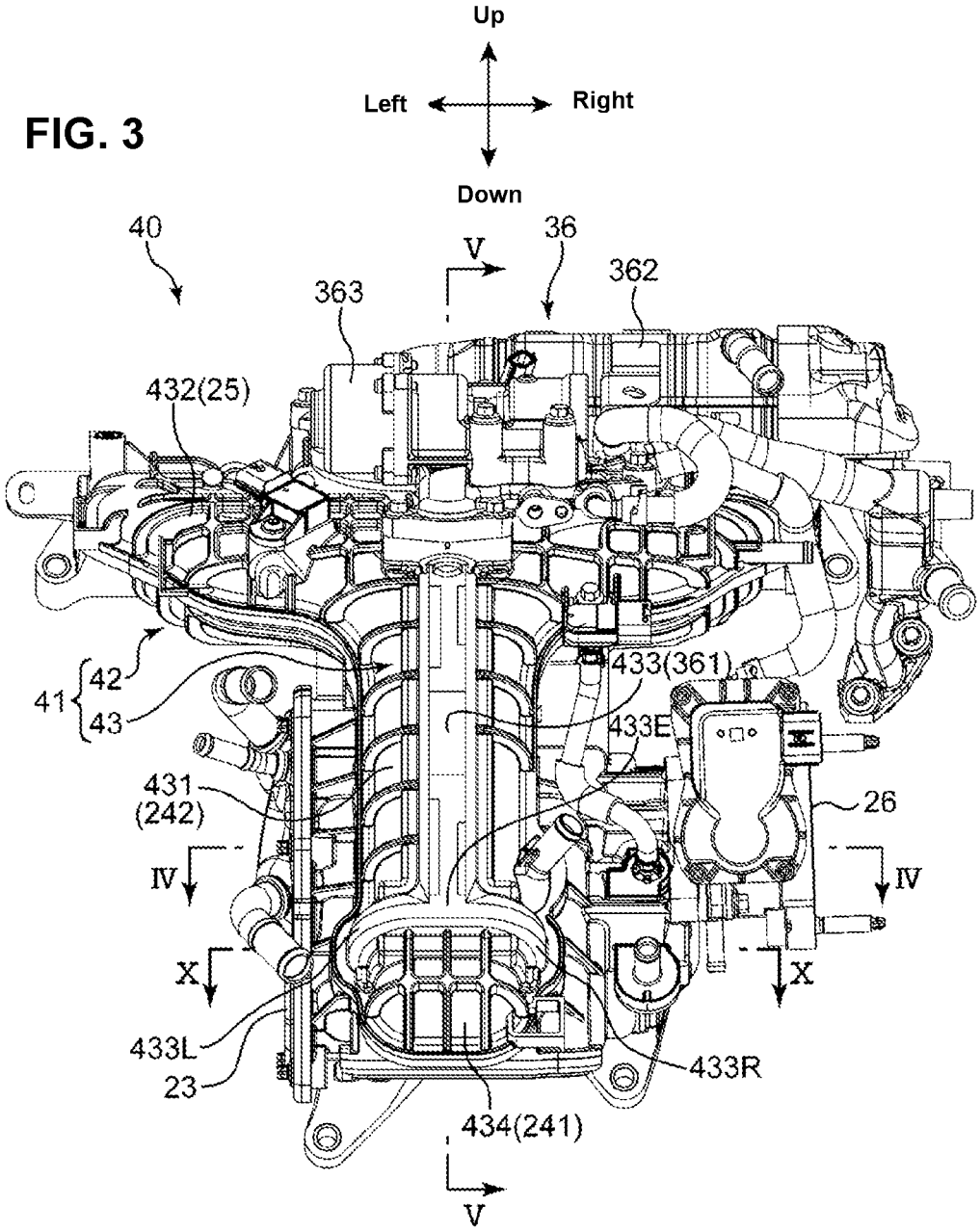
FIG. 3 is an elevational view of the intake device according to the first embodiment of the present invention.

FIG. 2 is a perspective view schematically showing an external appearance of the engine body 1 to which the intake unit 40 according to a first embodiment is applied, and FIG. 3 is an elevational view of the intake unit 40. In FIGS. 2, 3 and others, indications regarding longitudinal (forward, rearward), lateral (leftward, rightward), and vertical (upward, downward) directions are shown. These directional indications are described just for convenience's shake in order to facilitate explanations, and therefore these do not necessarily match actual directions and the present invention should not be limited by these.

The intake unit 40 is assembled to a forward-side face of the engine body 1. The intake unit 40 includes an intake housing 41 which forms a part of the intake passage where the intake air introduced into the engine body 1 flows. FIGS. 2 and 3 show a vertical passage portion 431 which partitions the downstream-side intake passage 24 of the intake passage 20, an intake manifold portion 432 which partitions the independent intake passage 25, and a protrusion portion 433 which partitions the downstream part of the EGR passage 361.

The intercooler 23 is arranged such that its front face and its upper face are enclosed by the vertical passage portion 431 and the intake manifold portion 432. The chamber 51 of the intercooler 23 constitutes a part of the intake housing 41. The intercooler core 52 is configured so that it can be inserted in a leftward direction and be drawn in a rightward direction relative to the intake housing 41. The valve unit 26 which is an intake-air introduction port to the intake unit 40 is arranged on a rightward side of the intercooler 23. The EGR cooler 362 and the EGR valve 363 of the EGR device 36 are assembled to an upper part of the intake manifold portion 432.

[Internal Structure of Intake Unit]

Figure 4:
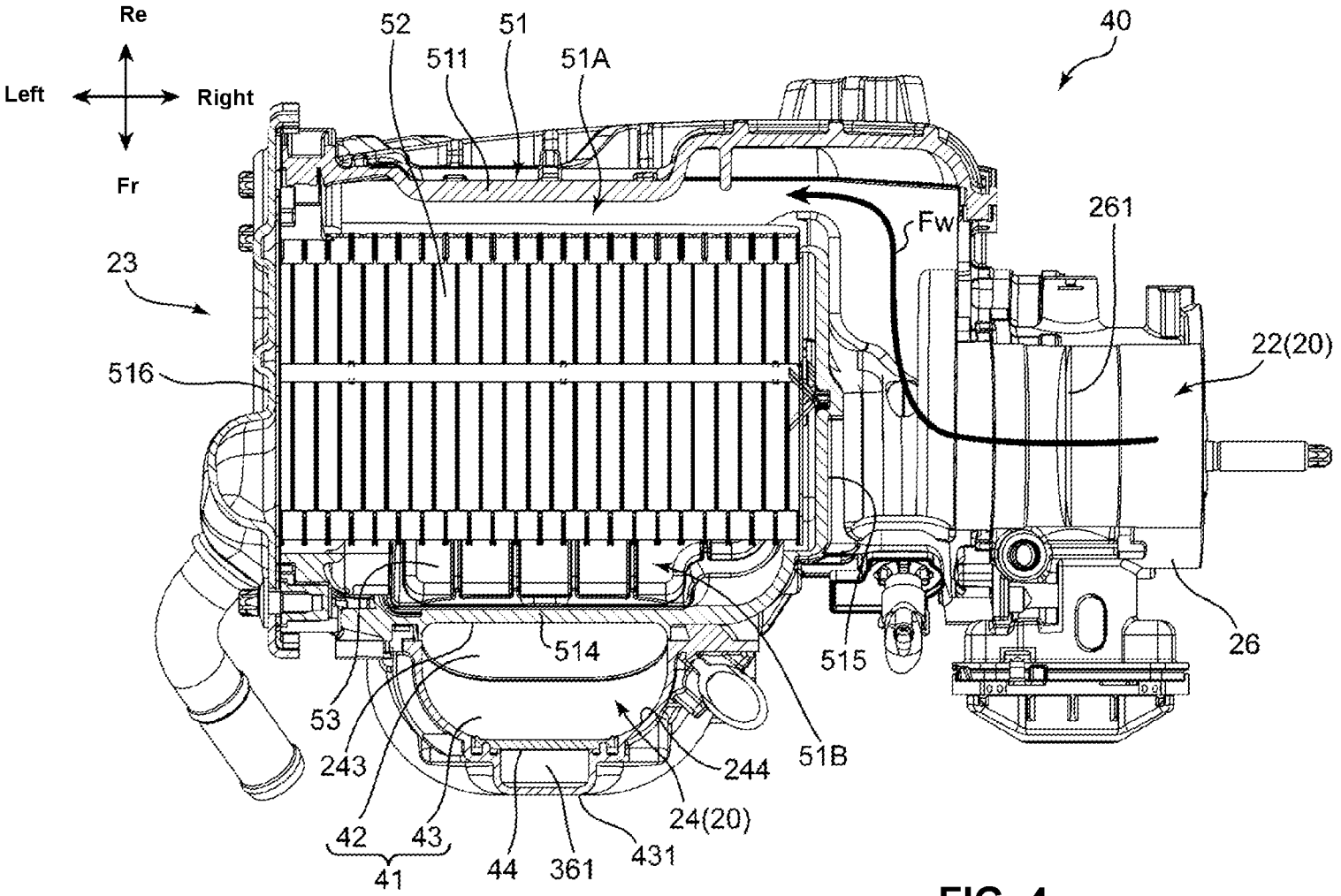
FIG. 4 is a sectional view taken along line IV-IV of FIG. 3.
Figure 5:
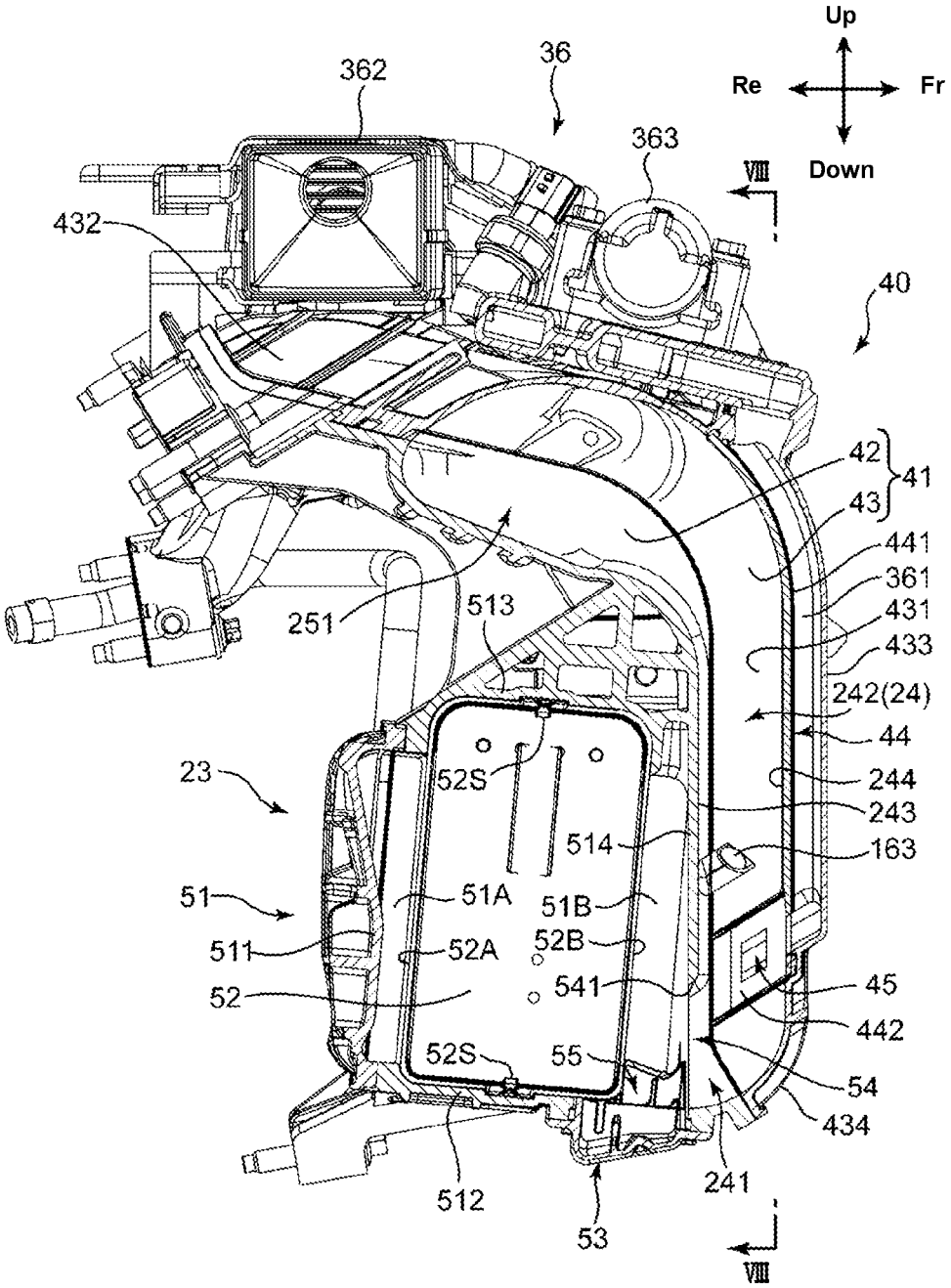
FIG. 5 is a sectional view taken along line V-V of FIG. 3.
Figure 6:
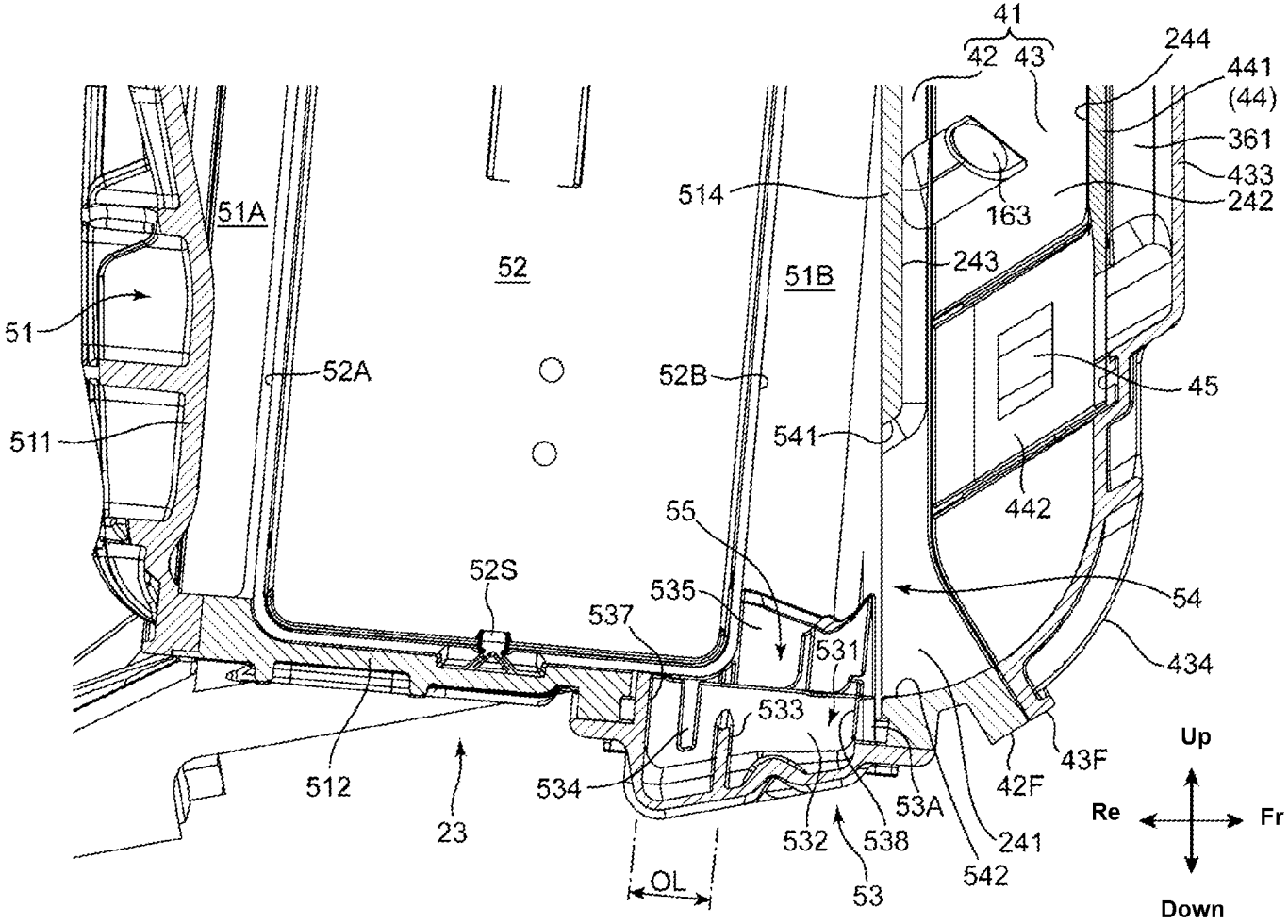
FIG. 6 is an enlarged view of a major part of FIG. 5.

Subsequently, an internal structure of the intake unit 40 will be described. FIG. 4 is a sectional view taken along line IV-IV of FIG. 3, FIG. 5 is a sectional view taken along line V-V of FIG. 3, and FIG. 6 is an enlarged view of a major part of FIG. 5. The intake housing 41 is formed by an integrated body of an inside housing 42 which is positioned on a rearward side and an outside housing 43 which is positioned on a forward side. The both housings 42, 43 are integrated by welding, screw attaching, or the like. FIG. 6 shows a flange portion 42F of the inside housing 42 and a flange portion 43F of the outside housing 43, which are connected to each other in such a manner that their lower end sections butt against each other.

The chamber 51 of the intercooler 23 is formed at the inside housing 42. The chamber 51 partitions a substantially rectangular-parallelopiped space where the intercooler core 52 is stored. The chamber 51 substantially comprises an upstream side wall 511, a bottom wall 512, an upper wall 513, a downstream side wall 514, a right wall 515, and a left wall 516. These walls 511-516 face an upper face, a bottom face, a rearward face, a forward face, a rightward face, and a leftward face of the intercooler core 52, respectively.

The upstream side wall 511 is a side wall positioned at a rear side of the chamber 51, which is positioned at the upstream side of the intake passage 20, i.e., at an inlet side of the chamber 51. The downstream side wall 514 is a side wall positioned at a front side (downstream side) of the chamber 51, which is positioned at an outlet side of the chamber 51. The bottom wall 512 and the upper wall 513 are respective walls which partition an lower face and an upper face of the chamber 51. The right wall 515 and the left wall 516 are respective walls which partition a right face and a left face of the chamber 51. Herein, the upstream side wall 511 is a wall which is attached to a body portion of the chamber 51 later. A part of the downstream side wall 514 is constituted by a bottom lid member 53 which is attached later.

The intercooler core 52 which is of the rectangular-parallelopiped shape is stored in the chamber 51, and spaces of an upstream chamber 51A and a downstream chamber 51B are formed in the chamber 51. The intercooler core 52 is a water-cooling type, which has a laminated core structure where there are provided plural plates including meandering-shaped cooling-water flow passages therein and cooling fins interposed between the plates. A circulation system of the cooling water which includes a water pump and a radiator, not illustrated, is attached to the intercooler core 52.

Core holding portions to respectively hold an upper face and a bottom face of a body portion of the intercooler core 52 are integrally provided at an upper end side and a lower end side of the intercooler core 52, which is not illustrated. Further, a seal member 52S to prevent leakage of the intake-air flowing is attached to each of an upper face side and a bottom face side of the intercooler core 52. The seal member 52S seals a gap between the bottom wall 512 of the chamber 51 and the bottom face of the intercooler core 52 and a gap between the upper wall 513 and the upper face of the intercooler core 52. The seal member 52S is a lip seal. While FIGS. 5 and 6 show a state where a lip portion of the seal member 52S expands, the lip portion is actually pressed so as to close each of the above-described gaps. That is, the intercooler core 52 is supported by the bottom wall 512 via the seal member 52S at the above-described bottom face side. It is prevented by the seal member 52S that the intake air flows downstream, not passing through the intercooler core 52.

The upstream chamber 51A is the space adjacent to an upstream-side face 52A of the intercooler core 52, which is connected to the upstream-side intake passage 22. The upstream-side wall 511 faces the upstream-side face 52A with a specified distance and partitions the space of the upstream chamber 51A. The downstream chamber 51B is the space adjacent to a downstream-side face 52B of the intercooler core 52, which is connected to the downstream-side intake passage 24. The downstream side wall 514 faces the downstream-side face 52B with a specified distance and partitions the space of the downstream chamber 51B. The intake air flows into the upstream chamber 51A from the upstream-side intake passage 22, passes through the intercooler core 52, and then is supplied to the downstream-side intake passage 24.

Referring to FIG. 4, the intake unit 40 is provided with the upstream-side intake passage 22 positioned downstream of the valve unit 26. A right face opening of the valve unit 26 is the intake-air introduction port to the intake unit 40. The intake air is taken in toward the leftward side from the intake-air introduction port. That is, the intake air is taken in to the intake unit 40 from a direction which is perpendicular (crossing) to a direction of the intake air passing through the intercooler core 52 in a plan view. Then, the intake air flows into the upstream chamber 51A by way of a downstream end portion of the upstream-side intake passage 22 which is configured to be curved rearwardly and then leftwardly in a crank shape.

An intake-air supply opening 54 to supply out the intake air to the downstream side from the chamber 51 is provided at the downstream side wall 514 (side wall). The intake-air supply opening 54 is arranged at a position corresponding to a lower-end area of the chamber 51 (a lower end portion of the downstream side wall 514). The intake-air supply opening 54 is an opening to collectively supply out the intake air which has been introduced into the chamber 51 and passed through the intercooler core 52. Herein, "collectively" supplying out means a state which is different from the manner disclosed in the above-described patent document in which the downstream side (outlet side) of the chamber 51 is opened entirely and therefore the intake air is supplied out randomly.

Specifically, the intake-air supply opening 54 has a smaller opening area than an area of the downstream-side face 52B of the intercooler core 52. The area of the downstream-side face 52B is an area of a forward-side face of the body portion of the intercooler core 52 except the above-described core holding portion, which is the area where the intake air can flow down. The opening area of the intake-air supply opening 54 is set to be smaller than the area of the downstream-side face 52B. That is, the intake-air supply opening 54 is the opening having an outlet which is smaller than an outlet of the intercooler core 52. The opening area of the intake-air supply opening 54 relative to the area of the downstream-side face 52B can be set within a range of about ½-1/10, preferably a range of about ⅓-⅛. In the present embodiment, the outlet opening of the intake air from the chamber 51 is limited to a range of the intake-air supply opening 54 having a substantially semicircular-shaped cross section (FIG. 8) which is formed around a lower end of the downstream side wall 514, and the intake air is supplied out from this limited opening range as a collective flow, which will be described specifically later.

A lower-face opening 55 is provided at a lower-face side of the chamber 51. Specifically, the lower-face opening 55 is opened at the bottom wall 512 in a lower side of the downstream chamber 51B. As shown in FIG. 6, the lower-face opening 55 is arranged at a position of the chamber 51 which overlaps, in the vertical direction, with an area from around the downstream of an arrangement position of the intercooler core 52 to an arrangement position of the intake-air supply opening 54. Herein, the lower-face opening 55 is used as an opening where a slide die is inserted or removed when the chamber 51 is formed.

The lower-face opening 55 is covered with the bottom lid member 53. In the present embodiment, the bottom lid member 53 serves as a reservoir of the condensed water generated in the intake passage 20 (the downstream-side intake passage 24). That is, the bottom lid member 53 is provided with a reservoir recess portion 531 to reserve the condensed water. The reservoir recess portion 531 is a cavity whose upper face is opened. As described above, the EGR gas and the blow-by gas which tend to generate the condensed water are introduced into the downstream-side intake passage 24. A volume of the cavity of the reservoir recess portion 531 is set properly so as to store a specified amount of condensed water. Herein, the stored condensed water is successively carried out to the downstream-side intake passage 24 by the intake-air flowing.

The bottom lid member 53 is positioned such that a part thereof overlaps, in the vertical direction, with the intercooler core 52 in an overlap area OL which is located at a lower-rearward side of the intake-air supply opening 54. In the present embodiment, about ⅓ of a longitudinal width of the reservoir recess portion 531 is set at the overlap area OL. The overlap area OL can be selected from a range of about ½-⅕ of the longitudinal width of the reservoir recess portion 531. Further, in the present embodiment, a bottom face of the reservoir recess portion 531 is oblique such that it goes down toward its rearward side. That is, a depth of the reservoir recess portion 531 is set such that its rearward side located in the overlap area OL is deeper than its forward side.

Figure 7:
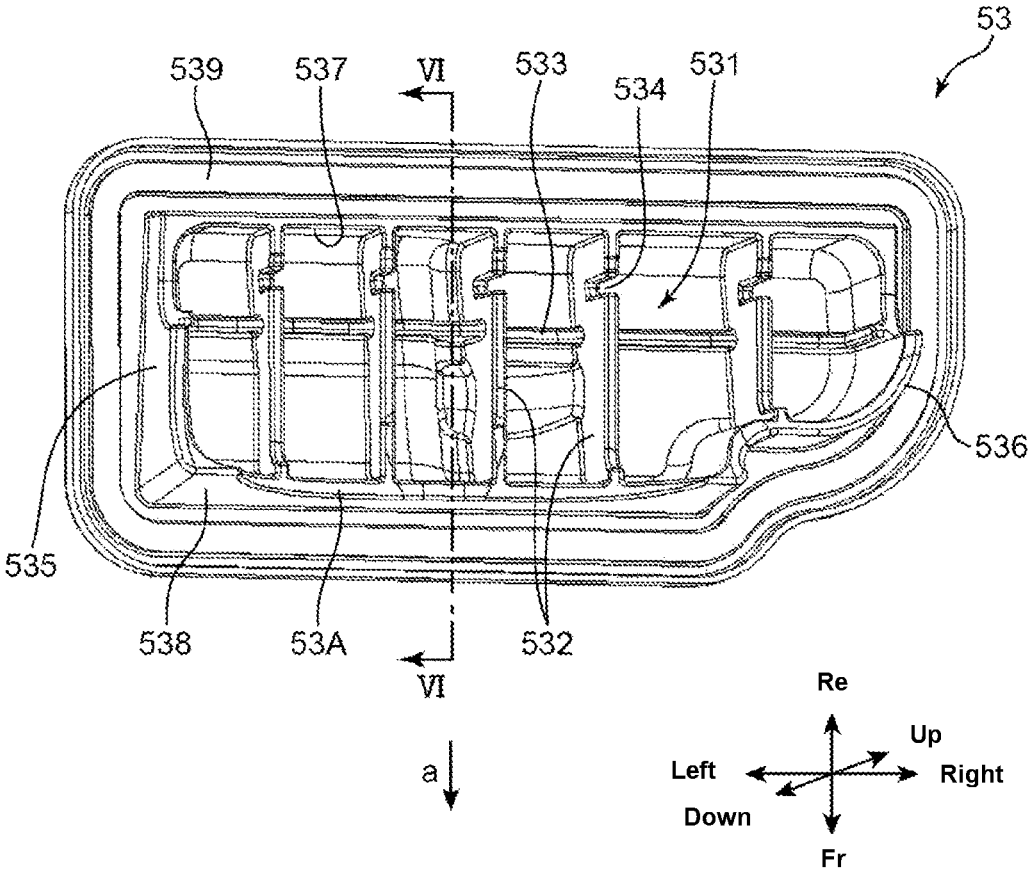
FIG. 7 is a perspective view of a bottom lid member of a chamber.

FIG. 7 is a perspective view of the bottom lid member 53. A line VI-VI shown in FIG. 7 corresponds to a sectional line of FIG. 6 (and FIG. 5). An arrow a shown in FIG. 7 shows a flowing direction of the intake air which is directed to the downstream-side intake passage from the chamber 51. The bottom lid member 53 includes the above-described reservoir recess portion 531 and also first ribs 532, a second rib 533, a connection groove 534, a pair of side-face ribs 535, 536, and an upstream wall 537 and a downstream wall 538.

The first ribs 532 and the second rib 533 are the ones which project upwardly from a bottom face of the cavity of the reservoir recess portion 531. The first ribs 532 are the ones extending longitudinally along the flowing direction of the intake air. The second rib 533 extends in a direction perpendicular (crossing) to the flowing direction of the intake air. The connection groove 534 is the groove which allows the stored condensed water to move between small partitions which are partitioned by the plural first ribs 532 and formed in the cavity in order to keep a condensed-water level at a constant level. The side-face rib 535 is provided to stand upwardly from a peripheral edge of the reservoir recess portion 531 at a left-end side of the reservoir recess portion 531, and the side-face rib 536 is provided to stand upwardly from the peripheral edge of the reservoir recess portion 531 at a right-end side of the reservoir recess portion 531.

The upstream wall 537 partitions a rear face of the cavity of the reservoir recess portion 531. The downstream wall 538 partitions a front face of the cavity and has a portion which extends upwardly from the peripheral edge of the reservoir recess portion 531. A cutout edge 53A having a semicircular shape which corresponds to a lower edge portion of the intake-air supply opening 54 is provided at the upward-extension portion of the downstream wall 538. A flange portion 539 is provided at the peripheral edge of the reservoir recess portion 531. This flange portion 539 is made to contact with a peripheral edge portion of the lower-face opening 55 at the bottom wall 512 and fixed to that portion by welding or the like.

Returning to FIG. 5, the outside housing 43 includes the vertical passage portion 431, the intake manifold portion 432, and the protrusion portion 433. The vertical passage portion 431 extends straightly in the vertical direction and partitions a passage having a semicircular cross section. A lower end part 434 of the vertical passage portion 431 is arranged at a position which faces the intake-air supply opening 54. An upper end of the vertical passage portion 431 is connected to the intake manifold portion 432 in a rearwardly-curved manner.

The intake manifold portion 432 has a passage which distributes the intake air to the plural cylinders 2 of the engine body 1. The plural independent intake passages 25 shown in FIG. 1 are provided inside the intake manifold portion 432. The protrusion portion 433 is configured to protrude in the vertical direction along the vertical passage portion 431 at a forward side wall portion (outside wall part 244) of the vertical passage portion 431. Referring to FIG. 3, the protrusion portion 433 is arranged around a center, in the lateral direction, of the vertical passage portion 431. The protrusion portion 433 has a forked downstream end 433E where a lower end thereof forks laterally. A left-side flow passage portion 433L and a right-side flow passage portion 433R respectively extend in the leftward direction and in the rightward direction from the forked downstream end 433E along an outer periphery of the outside wall part 244 having a semicircular cross section.

As shown in FIG. 5, the downstream-side intake passage 24 comprises an upstream end 241 which is connected to the intake supply opening 54 and an extension passage portion 242 which extends upwardly from the upstream end 241. The upstream end 241 is a portion positioned just downstream of the intake-air supply opening 54 which is partitioned by a member positioned near a forward lower end of the inside housing 42. The extension passage portion 242 extends upwardly from the upstream end 241 along the downstream side wall 514 of the chamber 51 and connects to the surge tank 251. An upstream portion of the extension passage portion 242 which is continuous to the upstream end 241 is a passage which is curved, with an angle of about 90 degrees, in a forward-and-upward direction. Further, a downstream portion of the extension passage portion 242 which is continuous to the surge tank 251 is a passage which is curved obliquely rearwardly-and-upwardly.

The above-described vertical passage portion 431 partitions the extension passage portion 242 together with a part of the inside housing 42. The extension passage portion 242 is partitioned by an inside wall part 243 which is positioned on a side of the chamber 51 and an outside wall part 244 which faces the inside wall part 243. The protrusion portion 433 partitions a downstream portion of the EGR passage 361 (a portion downstream of the EGR valve) which extends vertically on a forward side of the extension passage portion 242. A pair of EGR introduction ports 45 to join the EGR passage 361 to the downstream-side intake passage 24 are opened at right-and-left points in a lower-end area of the vertical passage portion 431. The left-side flow passage portion 433L and the right-side flow passage portion 433R are passages which introduce the EGR gas to the EGR introduction ports 45. Further, a blow-by gas introduction port 163 which recirculates the blow-by gas to the downstream-side intake passage 24 is opened at a portion in the lower-end area of the vertical passage portion 431 which is positioned slightly above the EGR introduction ports 45.

[Details of Intake-Air Supply Opening]

Figure 8:
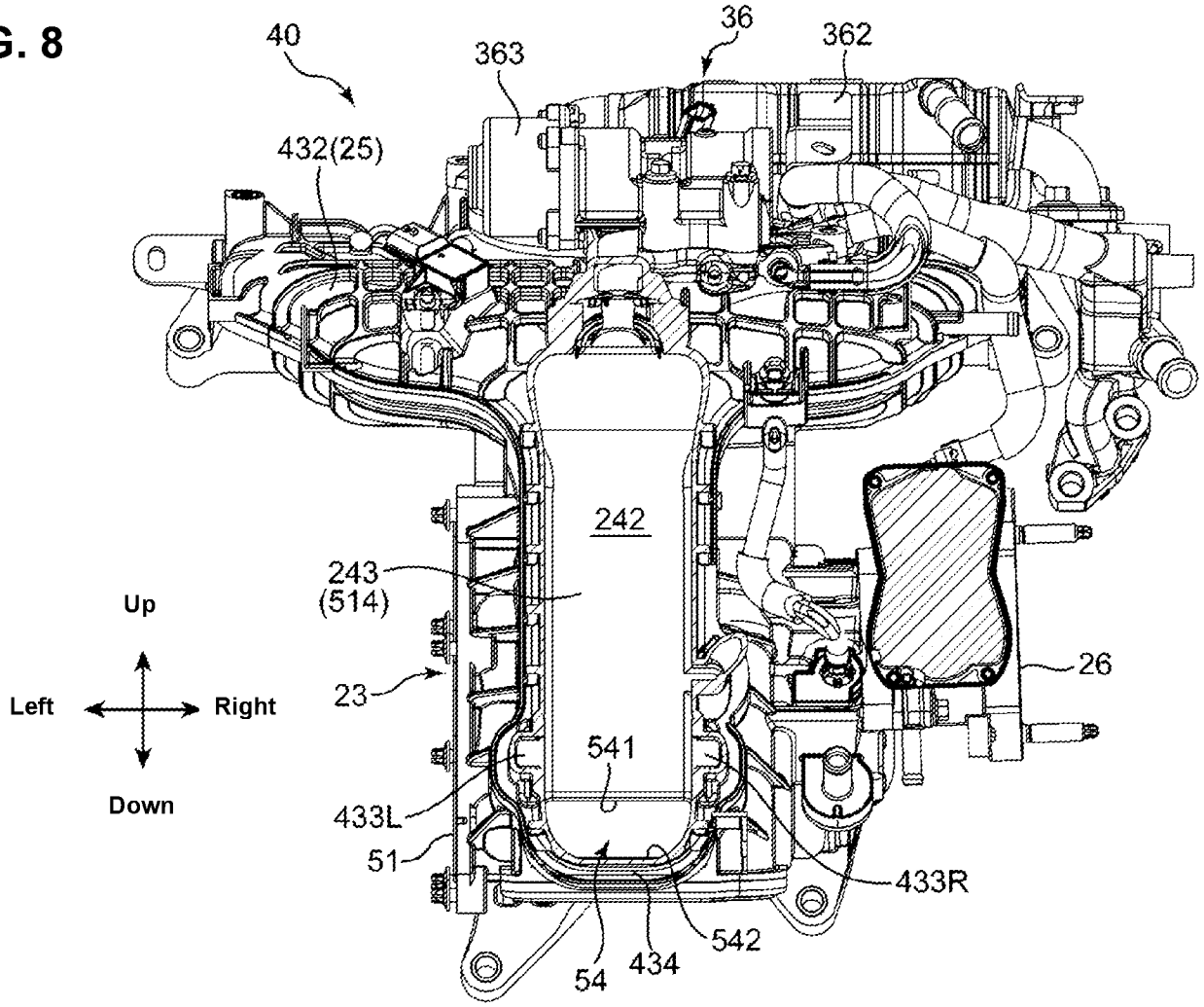
FIG. 8 is a sectional view taken along line VIII-VIII of FIG. 5.

Hereafter, a detained structure of a major part will be described. The intake-air supply opening 54 will be described first. FIG. 8 is a sectional view taken along line VIII-VIII of FIG. 5, which shows a shape of the intake-air supply opening 54. The intake-air supply opening 54 is an opening having a semicircular-shaped cross section. An opening edge partitioning the intake-air supply opening 54 is an upper edge portion 541 and a semicircular-shaped edge portion 542. The upper edge portion 541 is a straight-shaped edge portion which extends in the lateral direction. The semicircular-shaped edge portion 542 is an edge portion which is positioned below the upper edge portion 541 and extends from right-and-left both ends of the upper edge portion 541, being curved downwardly and inwardly. Herein, a lower end part of the semicircular-shaped edge portion 542 extends straightly in the lateral direction.

The upper edge portion 541 of the intake-air supply opening 54 is configured to separate the intake air flowing from the inside wall part 243 and to form a main stream of flowing of the intake air inside the extension passage portion 242 when the intake air flows into the extension passage portion 242 from the inside of the chamber 51, passing through the upstream end 241. The straight-shaped upper edge portion 541 is one embodiment to perform (achieve)

the above-described function (configuration). This function will be described specifically referring to FIG. 13.

As apparent from FIG. 8, the intake-air supply opening 54 is arranged in the lower-end area of the chamber 50. As described above, the intake-air supply opening 54 is the opening which has the smaller sectional area than the outlet of the intercooler core 52 and supplies the intake air collectively to the downstream-side intake passage 24. In the present invention, an arrangement position of the intake-air supply opening 54 is not limited in particular as long as the above-described sectional-area relationship is satisfied. However, in a case where the intake-air supply opening 54 is arranged in the lower-end area of the chamber 50 like the present embodiment, the length of the extension passage portion 242 extending upwardly along the chamber 51 can be properly long.

That is, in the intake unit 40 in which the intake manifold portion 432 is arranged above the chamber 51 for compactness, the extension passage portion 242 can be made longer by arranging the intake-air supply opening 54 at a position which is closer to the lower end of the chamber 51. This means that the mixing time of the EGR gas and the blow-by gas which are to be introduced into the extension passage portion 242 and mixed with the intake air can be made properly long. Accordingly, after the EGR gas and the blow-by gas have been dispersed to the intake gas sufficiently evenly, this intake air can be introduced into the cylinders 2.

[Details of Downstream-Side Exhaust Passage and its Vicinity]

Figure 9:
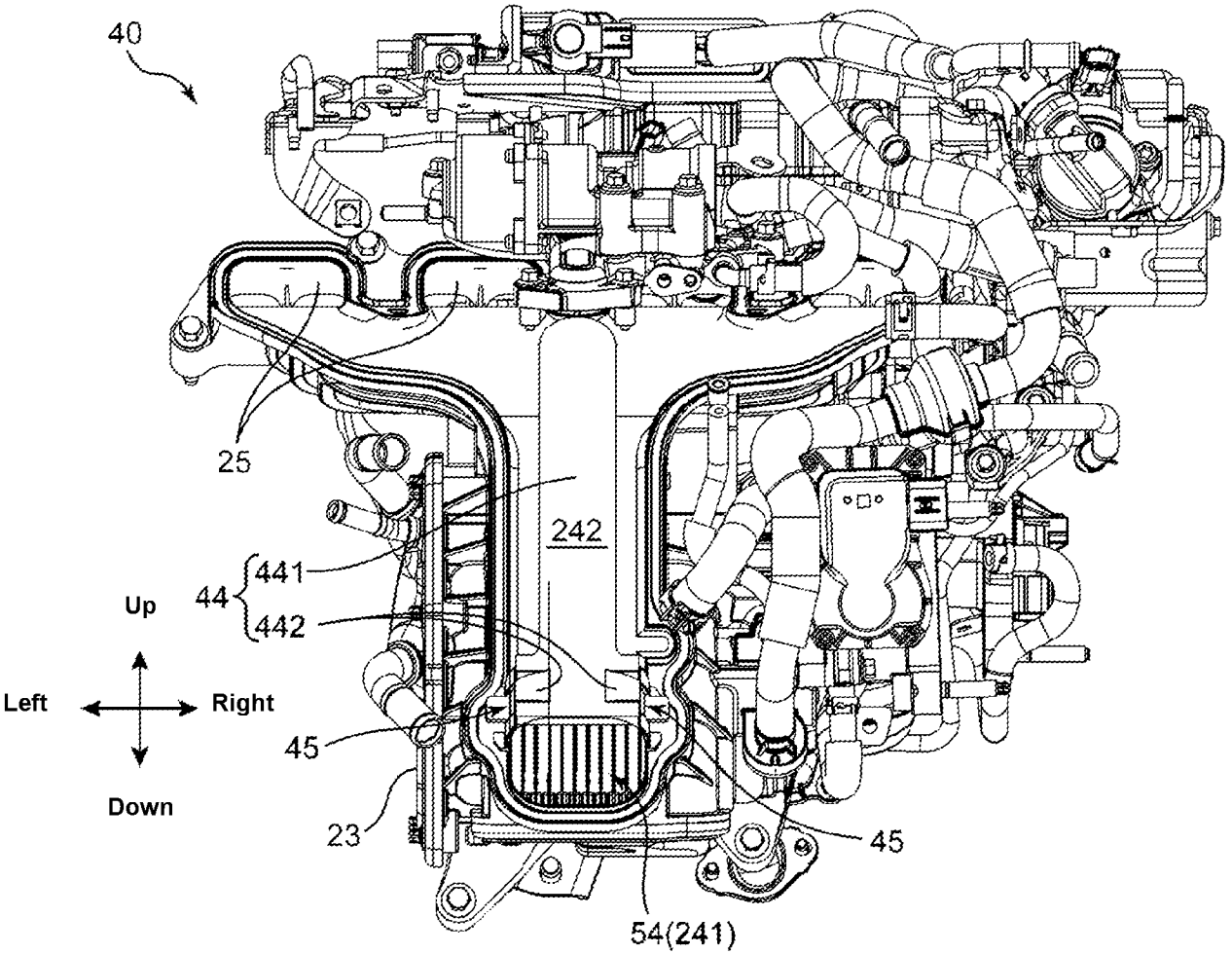
FIG. 9 is an elevational view of the intake device in a state where an outside housing of an intake housing is removed.
Figure 10:
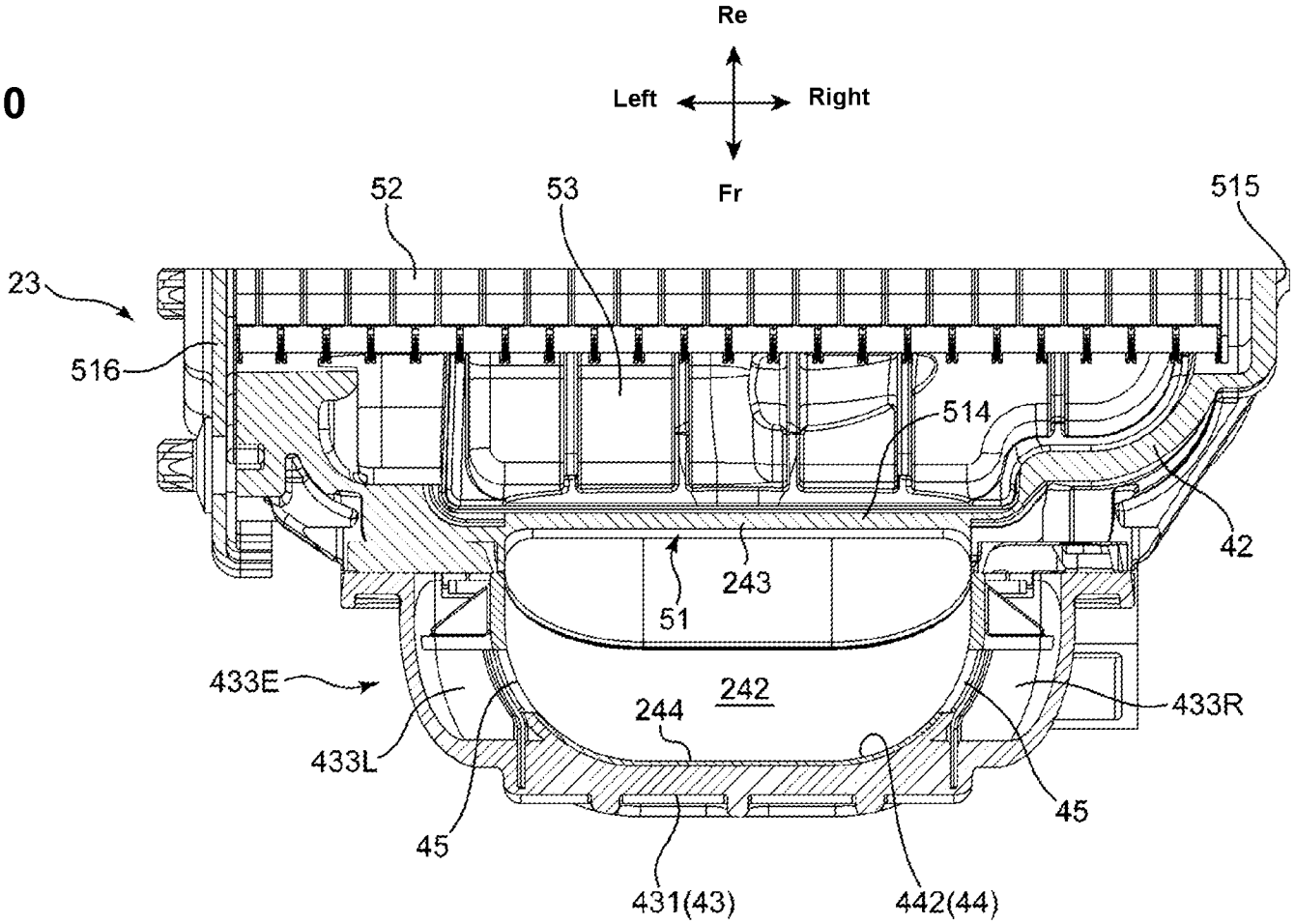
FIG. 10 is a sectional view taken along line X-X of FIG. 3.

Next, a detailed structure of the downstream-side intake passage 24 and its vicinity will be described further referring to FIGS. 9 and 10. FIG. 9 is an elevational view of the intake unit 40 in a state where the outside housing 43 is removed from the intake housing 41. FIG. 10 is a sectional view taken along line X-X of FIG. 3.

The extension passage portion 242 of the downstream-side intake passage 24 is partitioned by the inside wall part 243 and the outside wall part 244 which face each other. The inside wall part 243 is a part of the front-side face of the downstream side wall 514 of the chamber 51 with which the inside housing 42 is provided (see FIGS. 5 and 8). The outside wall part 244 is a wall portion which the outside housing 43 is provided with and which has a laterally-wide U-shaped cross section as shown in FIG. 10. The inside housing 42 and the outside housing 43 are joined at the flange portions 42F, 43F and others, whereby the inside wall part 243 and the outside wall part 244 form the extension passage portion 242 having the semicircular-shaped cross section.

The sectional shape of the extension passage portion 242 is set to be substantially the same as the opening shape of the intake-air supply port 54. An upstream part of the extension passage portion 242 which is continuous to the upstream end 241 is a passage curved upwardly. The lower end part 434 of the vertical passage portion 431 partitions the above-described upstream part of the extension passage portion 242. This lower end part 434 is also set to be substantially the same as the opening shape of the intake-air supply opening 54. That is, a passage extending from the intake-air supply opening 54 to the upstream end 241 and the extension passage portion 242 has the same semicircular shape as the intake-air supply opening 54 in the sectional view.

Referring to FIGS. 4, 5 and 9, a central area, in the lateral width direction, of the outside wall part 244 is constituted by a partitioning plate 44. The protrusion portion 433 which partitions the EGR passage 361 protrudes forwardly in a U shape in the sectional view (FIG. 4). The portioning plate 44 is attached to an inner surface of the vertical passage portion 431 such that it closes an opening of a rising base part of the protrusion portion 433. An inside of the vertical passage portion 431 is partitioned by the partitioning plate 44 into the downstream-side intake passage 24 (the extension passage portion 242) positioned on the rearward side and the EGR passage 361 positioned on the forward side. Herein, the sectional area of the EGR passage 361 is set to be smaller than that of the extension passage portion 242. This is because if the sectional area of the EGR passage 361 is set to be large, flowing of the EGR gas becomes so irregular that the EGR gas may not hit against the intake air properly.

Figure 11:
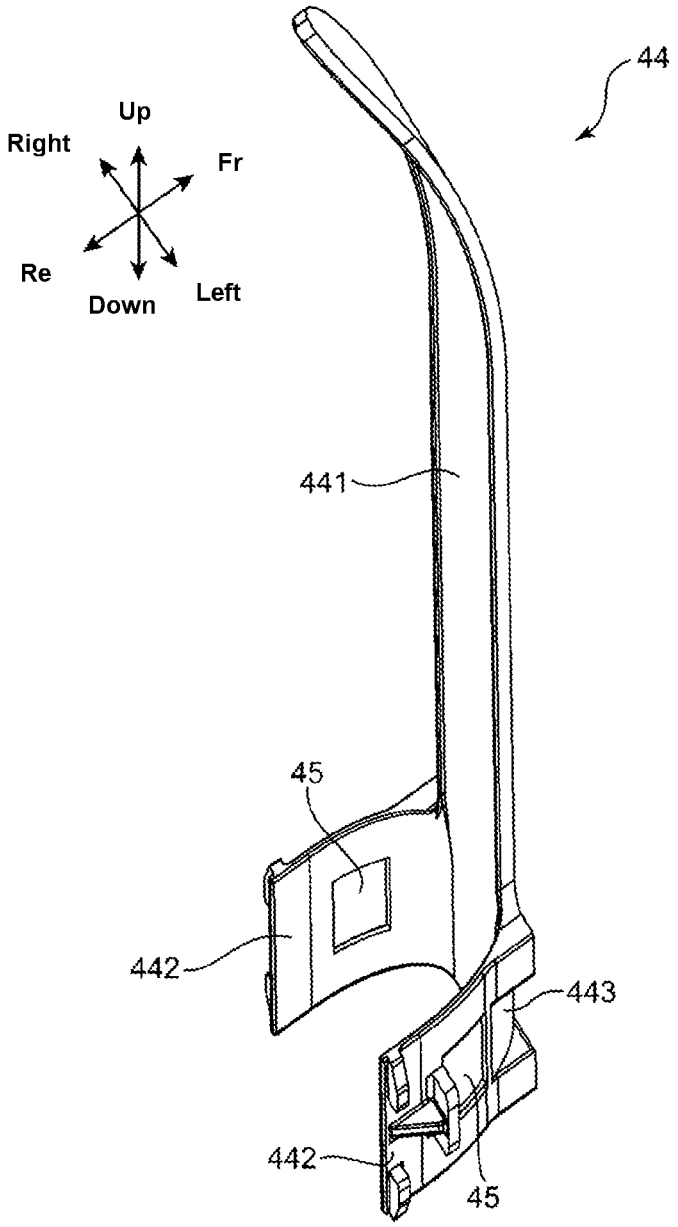
FIG. 11 is a perspective view of a partitioning plate.

FIG. 11 is a perspective view of the partitioning plate 44. The partitioning plate 44 includes a band-shaped piece 441 which extends vertically and a pair of curved-face pieces 442 which are provided to be continuous to a lower end of the band-shaped piece 441. The band-shaped piece 441 is a flat plate member, and the downstream-side intake passage 24 is configured to be curved along a rearward curved-face shape of an upper end part of the band-shaped piece 441. The pair of curved-face pieces 442 extend in the lateral direction from the lower end of the band-shaped piece 441. The curved-face pieces 442 have a curved face which matches a curved-face shape of the outside wall part 244 in the sectional view of the extension passage portion 242 (FIG. 10). A forked passage wall 443 which is formed by a groove-shaped recess portion is provided at a back face (front face) of the curved-face pieces 442. The forked passage wall 443 partitions the EGR gas passage together with the left-side flow passage portion 433L and the right-side flow passage portion 433R of the forked downstream end 433E.

The EGR introduction port 45 is formed at each of the curved-face pieces 442. That is, the EGR introduction ports 45 are arranged at the curved-face pieces 442 which are forked from the downstream end 433E. The EGR introduction port 45 is a square opening and formed at a position which is continuous to the forked passage wall 443. As shown in FIG. 10, a space of the extension passage portion 242 and a flow passage space of the left-side flow passage portion 433L and the right-side flow passage portion 433R are continuous to each other by the EGR introduction ports 45. The EGR introduction ports 45 are arranged at a position capable of discharging (supplying) the EGR gas toward the main stream of flowing of the intake air, which will be described later.

The EGR introduction ports 45 are arranged in the lower-end area of the extension passage portion 242. In the present embodiment, as shown in FIGS. 5 and 6, the curved-face pieces 442 of the partitioning plate 44 and the upper edge portion 541 of the intake-air supply opening 54 are arranged at respective positions which overlap with each other in the vertical direction. The EGR introduction ports 45 are arranged such that their lower-end edge portions are located substantially at the same level as the upper edge portion 541. Further, the EGR introduction ports 45 are arranged in a specified area of the extension passage portion 242 which is curved upwardly from the intake-air supply opening 54 opened forwardly by way of the upstream end 241, wherein the above-described specified area is a position where the above-described upwardly curving is just complete. This arrangement can make the length of the extension passage portion 242 positioned downstream of the EGR introduction potions 45 properly long. Thereby, the mixing time of the EGR gas with the intake air is made so long that the EGR gas can be properly mixed with intake air evenly.

The blow-by introduction port 163 is arranged at a position slightly above the EGR introduction port 45. The blow-by introduction port 163 is opened at the outside wall part 244 in an area adjacent to the curved-face pieces 442 provided with the EGR introduction ports 45.

[Movement of Intake Air]

Figure 12:
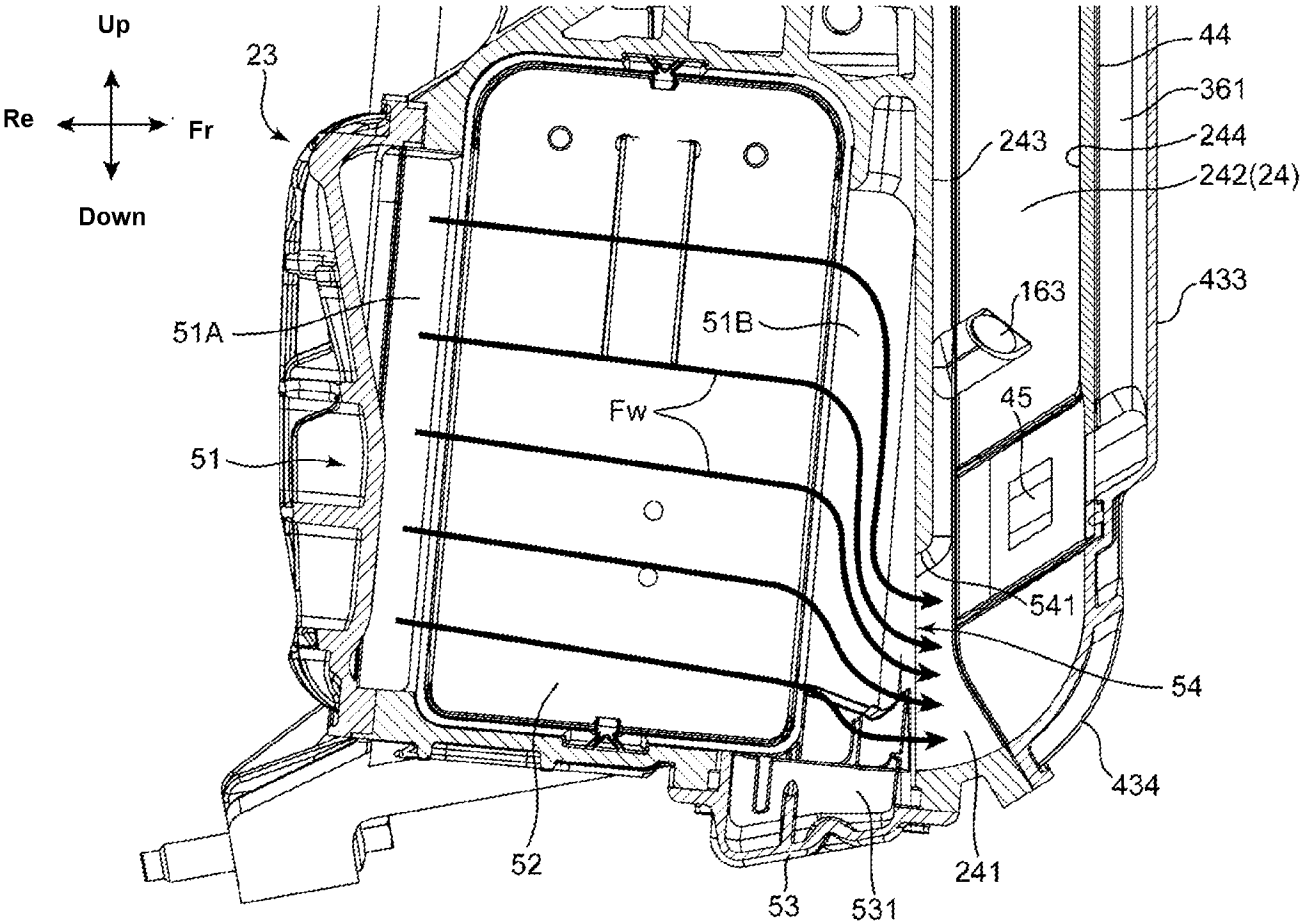
FIG. 12 is an enlarged view of a major part of FIG. 5, which shows flows of intake air passing through an intercooler.

FIG. 12 is an enlarged view of a major part of FIG. 5, which shows flows Fw of the intake air passing through the intercooler 23. The intake air taken in to the intake unit 40 flows into the upstream chamber 51A of the chamber 51 from the upstream-side intake passage 22 (see FIG. 4 as well). The upstream chamber 51A is a space extending over an entire length, in a vertical width and in a lateral width, of the intercooler core 52. Accordingly, the intake-air flows Fw pass through a vertical-and-lateral entire area of the intercooler core 52 and reach the downstream chamber 51B. Herein, the intake-air flows Fw have heat exchanging with the above-described cooling fins of the intercooler core 52, so that the intake-air flows Fw are cooled properly.

A passage extending from the downstream chamber 51B toward the downstream-side intake passage 24 is limited to a passage which passes through the intake-air supply opening 54. The intake-air supply opening 54 is arranged in the lower-end area of the chamber 51. Accordingly, the intake-air flows Fw flowing into the downstream chamber 51B from the intercooler core 52 are collected so as to flow toward the intake-air supply opening 54, so that they become a collective flow finally. Thereby, the intake air passing through the intercooler core 52 is prevented from flowing into the downstream-side intake passage 24 irregularly. After passing through the intake-air supply opening 54, the intake-air flows Fw flow into the downstream-side intake passage 24. That is, the intake-air flows Fw flow from the upstream end 241 connected to the intake-air supply opening 54 to the extension passage portion 242 which is curved upwardly and extends. Herein, the intake-air flows Fw are primarily caused by a negative pressure which is generated through combustion activities of the cylinders 2.

Figure 13:
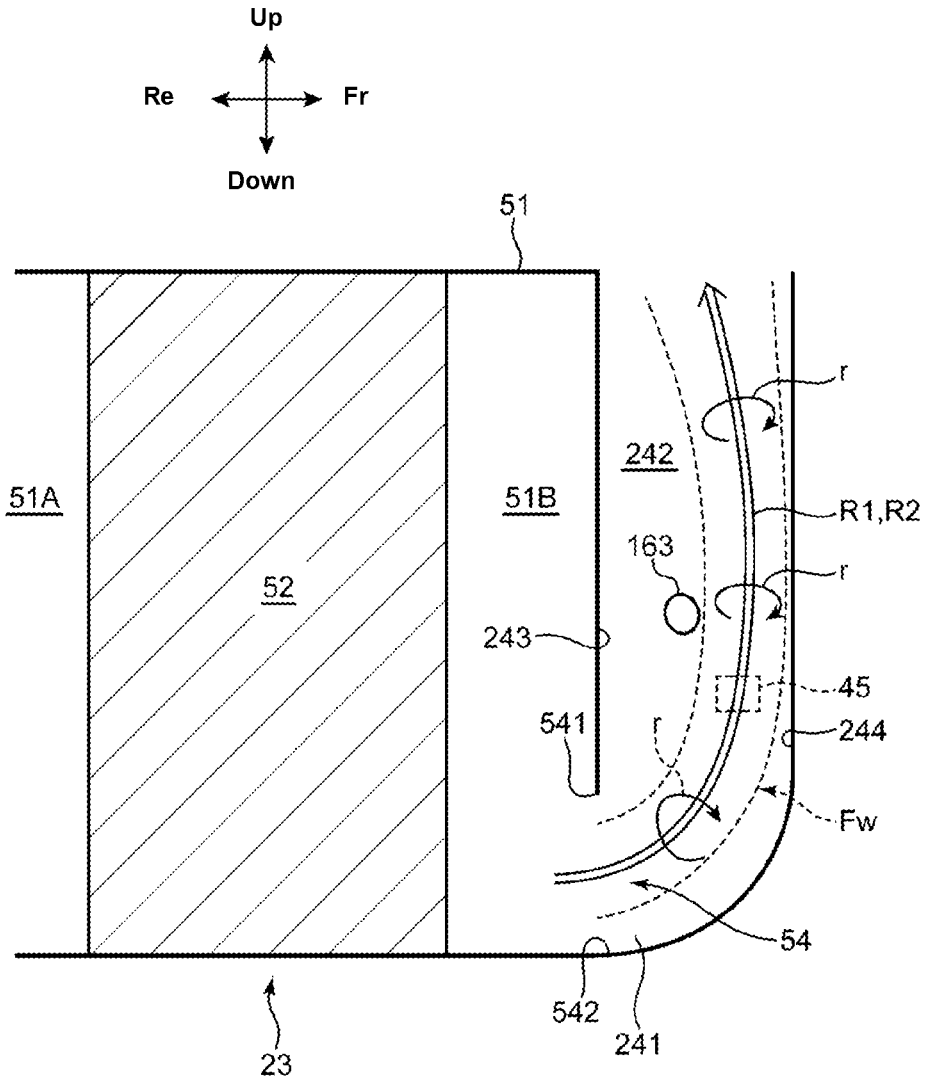
FIG. 13 is a schematic diagram explaining a main stream of flowing of the intake air.
Figure 14:
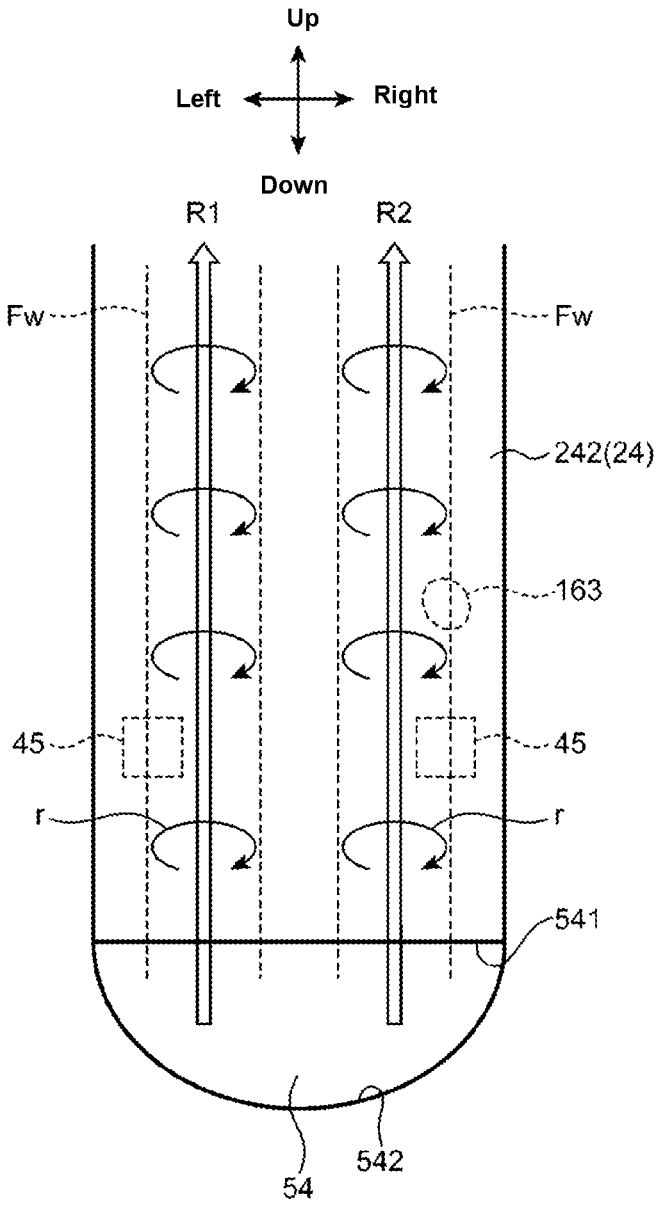
FIG. 14 is a schematic diagram explaining the main stream of flowing of the intake air.

FIGS. 13 and 14 are schematic diagrams which show flowing of the intake-air flows Fw after flowing out of the intake-air supply opening 54 in order to explain flowing main streams R1, R2. The intake-air supply opening 54 is an opening having a semicircular shape in its sectional view, and has the upper edge portion 541 extending straightly in the lateral direction. The intake air is introduced into the downstream-side intake passage 24, passing through the upper edge portion 541 which is not so greatly curved upwardly and positioned in the lower area of the chamber 51, so that the flowing main streams R1, R2 of the intake air which flow down in the vicinity of the outside wall part 244 are generated. That is, the intake-air flows Fw becomes the flowing main streams R1, R2 which flow down not in the area along the wall surface of the inside wall part 243 but on a flowing route which is forwardly separated from the inside wall part 243.

Further, the extension passage portion 242 is curved upwardly from the upstream end 241 connected to the intake-air supply opening 54 along the chamber 51. Accordingly, the flowing main streams R1, R2 of the intake-air flows Fw become flowing which go upwardly along the outside wall part 244 with secondary flows r which swirl around axes of the flowing main streams R1, R2. In the present embodiment, in particular, a sectional shape of the upwardly-curved route extending from the intake-air supply opening 54 toward the extension passage portion 242 by way of the upstream end 241 is of a semicircular shape which has the same size and shape as the intake-air supply opening 54 which has the upper edge portion 541 and the semicircular-shaped edge portion 542. Therefore, a pair of flowing main streams R1, R2 which flow upwardly in parallel, being separated from each other, are generated. Further, when the intake-air flows Fw pass through the extension passage portion 242 which is considered as a curved pipe curved upwardly, the secondary flows r tend to be generated and maintained more easily.

A pair of right-and-left EGR introduction ports 45 are arranged at respective positions corresponding to the passing routes of the flowing main streams R1, R2 with the above-described secondary flows r. That is, the EGR introduction ports 45 are provided at the outside wall part 244 so that the EGR gas can be discharged toward the flowing main streams R1, R2 of the intake air. The blow-by introduction port 163 is also arranged at a position capable of discharging (supplying) the blow-by gas toward the flowing main stream R2.

Figure 15:
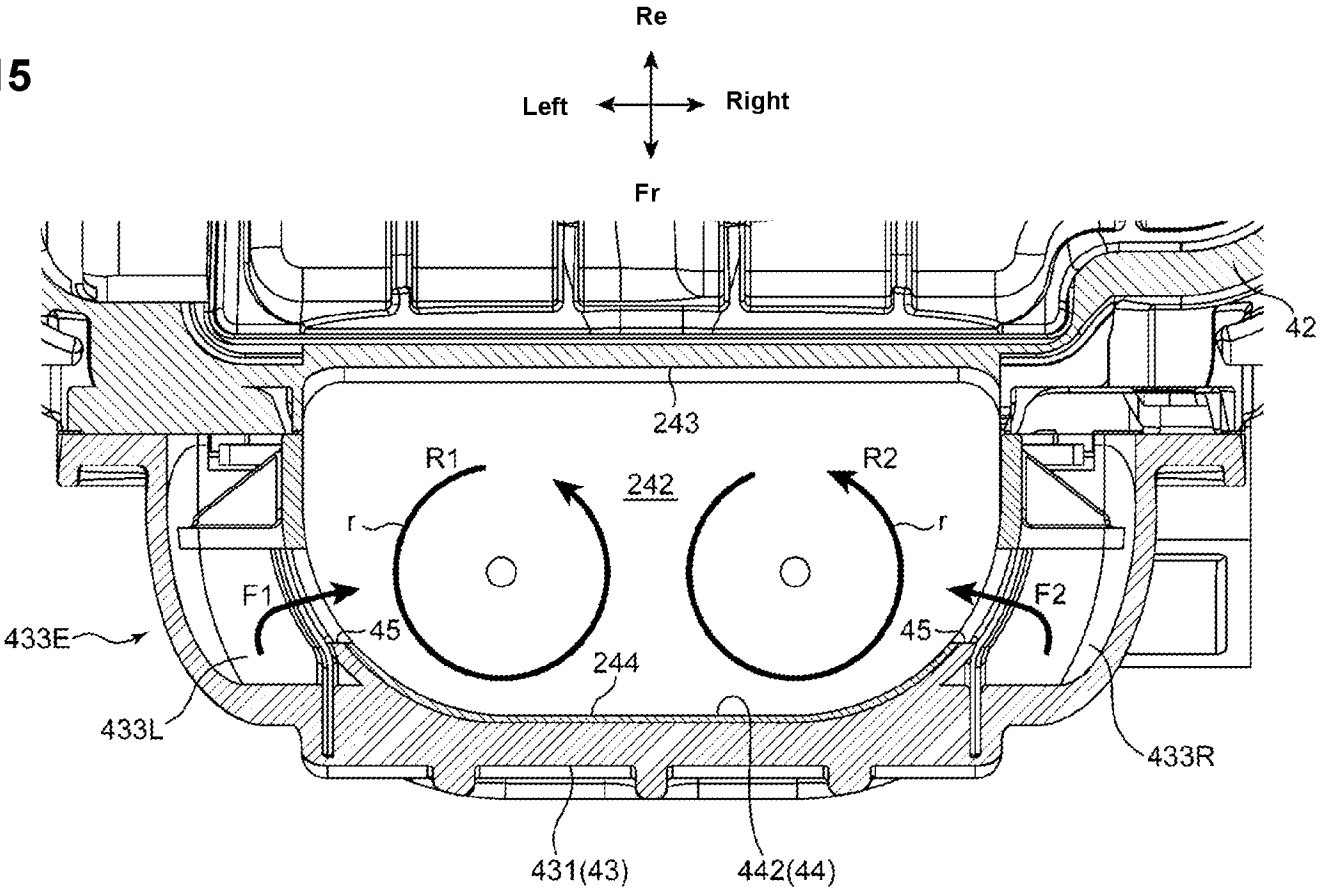
FIG. 15 is an enlarged view of a major part of FIG. 10, which explains discharging (supplying) of EGR gas toward the main stream of flowing of the intake air.

FIG. 15 is an enlarged view of a major part of FIG. 10, which explains discharging of EGR gases F1, F2 toward the flowing main streams R1, R2 of the intake air. The EGR introduction ports 45 are respectively opened to right-and-left side surfaces of the vertical passage portion 431 at positions which are closer to the outside wall part 244 than the inside wall part 243. The flowing main streams R1, R2 of the intake air also pass through positions which are closer to the outside wall part 244 than the inside wall part 243 because of the function of the upper edge portion 541 of the intake-air supply opening 54.

When the EGR gasses F1, F2 are introduced into the extension passage portion 242 from the EGR introduction ports 45, the EGR gas F1 is discharged toward the flowing main stream R1 and the EGR gas F2 is discharged toward the flowing main stream R2. As described above, the flowing main streams R1, R2 are accompanied with the secondary flows r. Accordingly, the EGR gasses F1, F2 which have hit against the flowing main streams R1, R2 come to properly mix with the intake-air flowing generating the flowing main streams R1, R2 with the secondary flows r. That is, the EGR gasses F1, F2 hit against the flowing main streams R1, R2 which flow upwardly, swirling, so that the EGR gasses F1, F2 mix with the intake air properly. Accordingly, the intake air can be distributed to the plural cylinders 2 in a state where the EGR gasses F1, F2 have been dispersed evenly, so that the stability of the combustion can be properly secured.

The blow-by gas to be introduced into the extension passage portion 242 from the blow-by introduction port 163 is similar to the above-described EGR gas. The blow-by introduction port 163 is also arranged at a position corresponding to the passing route of the flowing main streams R1, R2. Accordingly, the blow-by gas can be mixed with the intake air properly.

Second Embodiment

Figure 18:
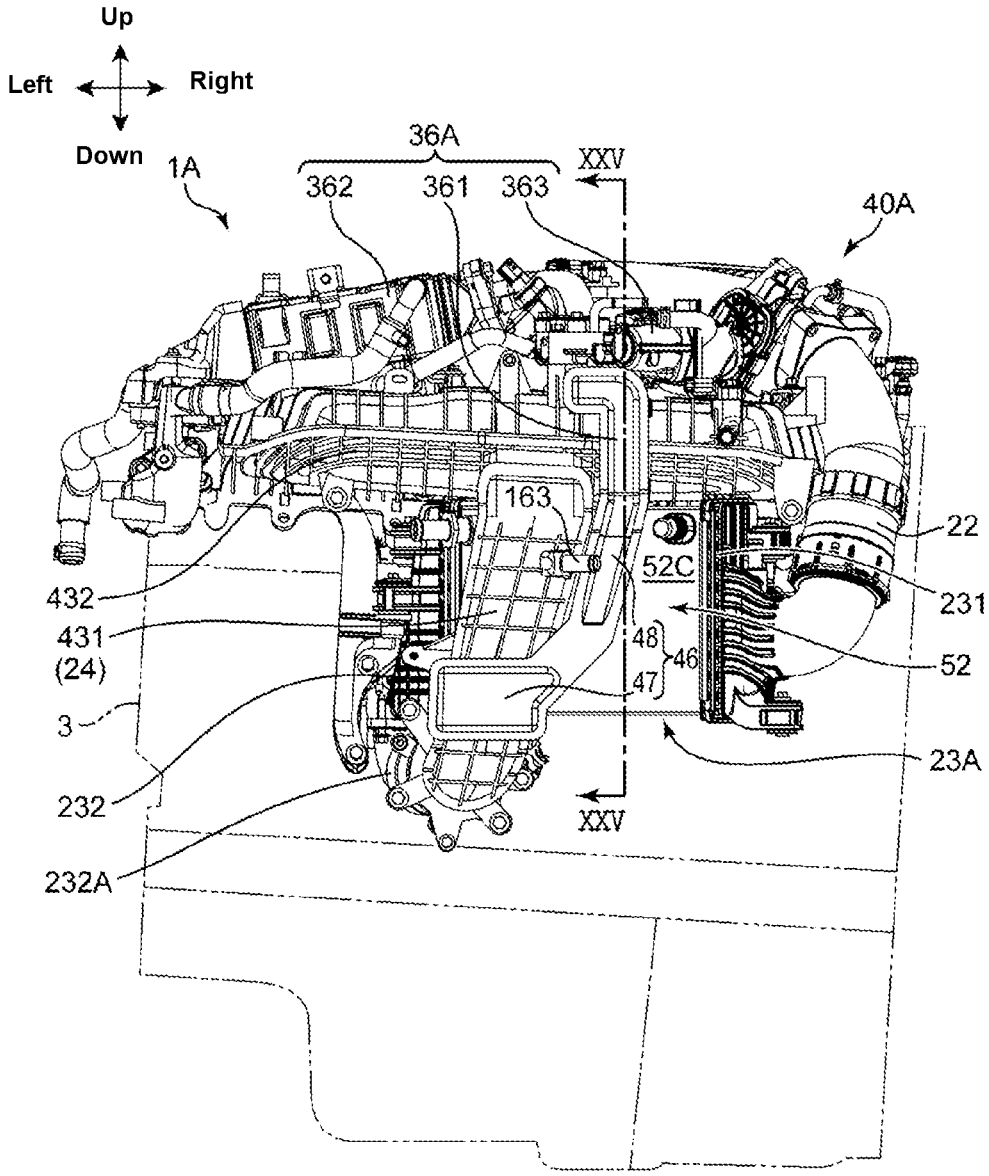
FIG. 18 is a perspective view schematically showing an external appearance of an engine to which an intake device according to a second embodiment of the present invention is applied.
Figure 19:
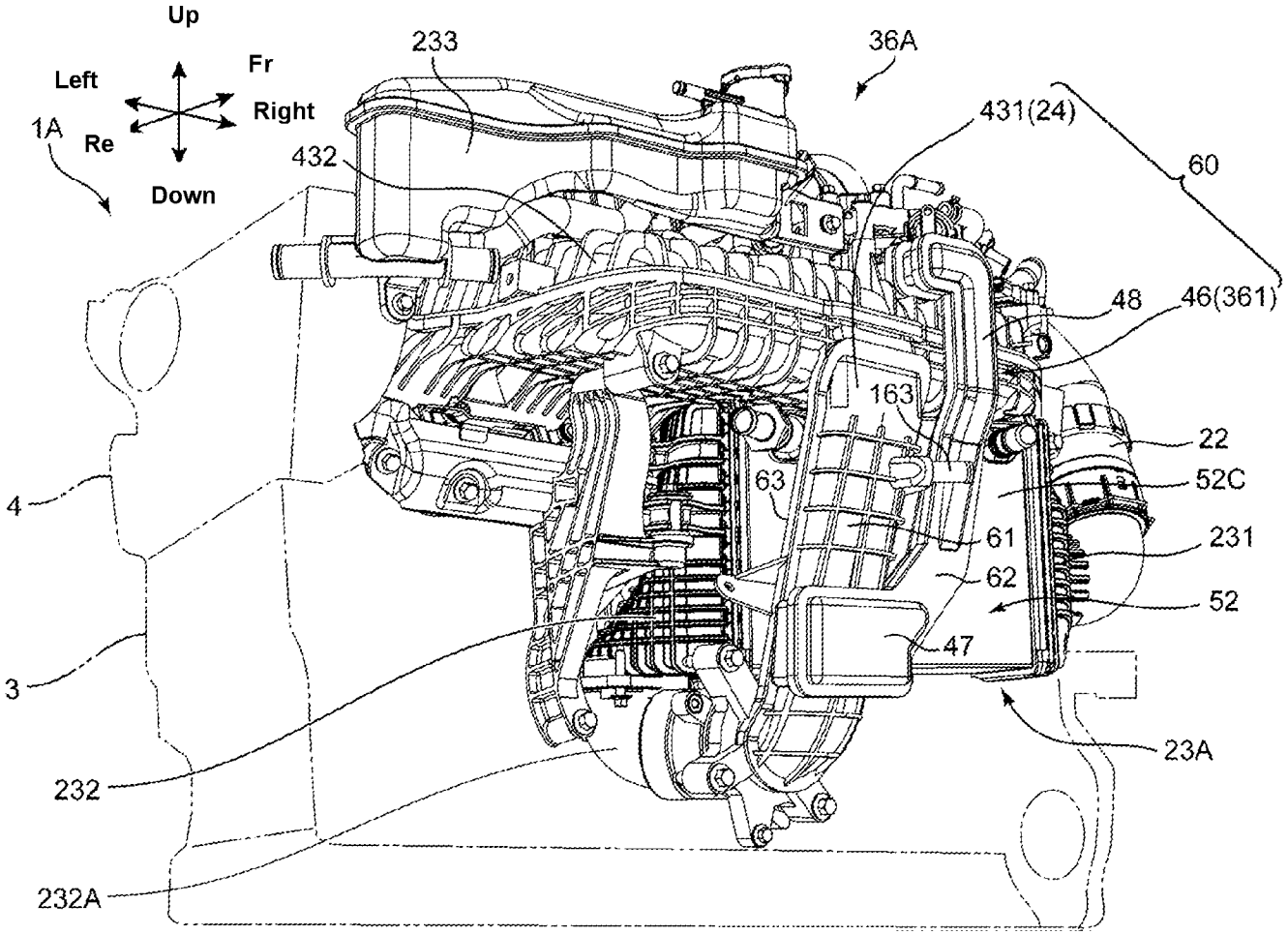
FIG. 19 is a perspective view of the intake device of the second embodiment.
Figure 20:
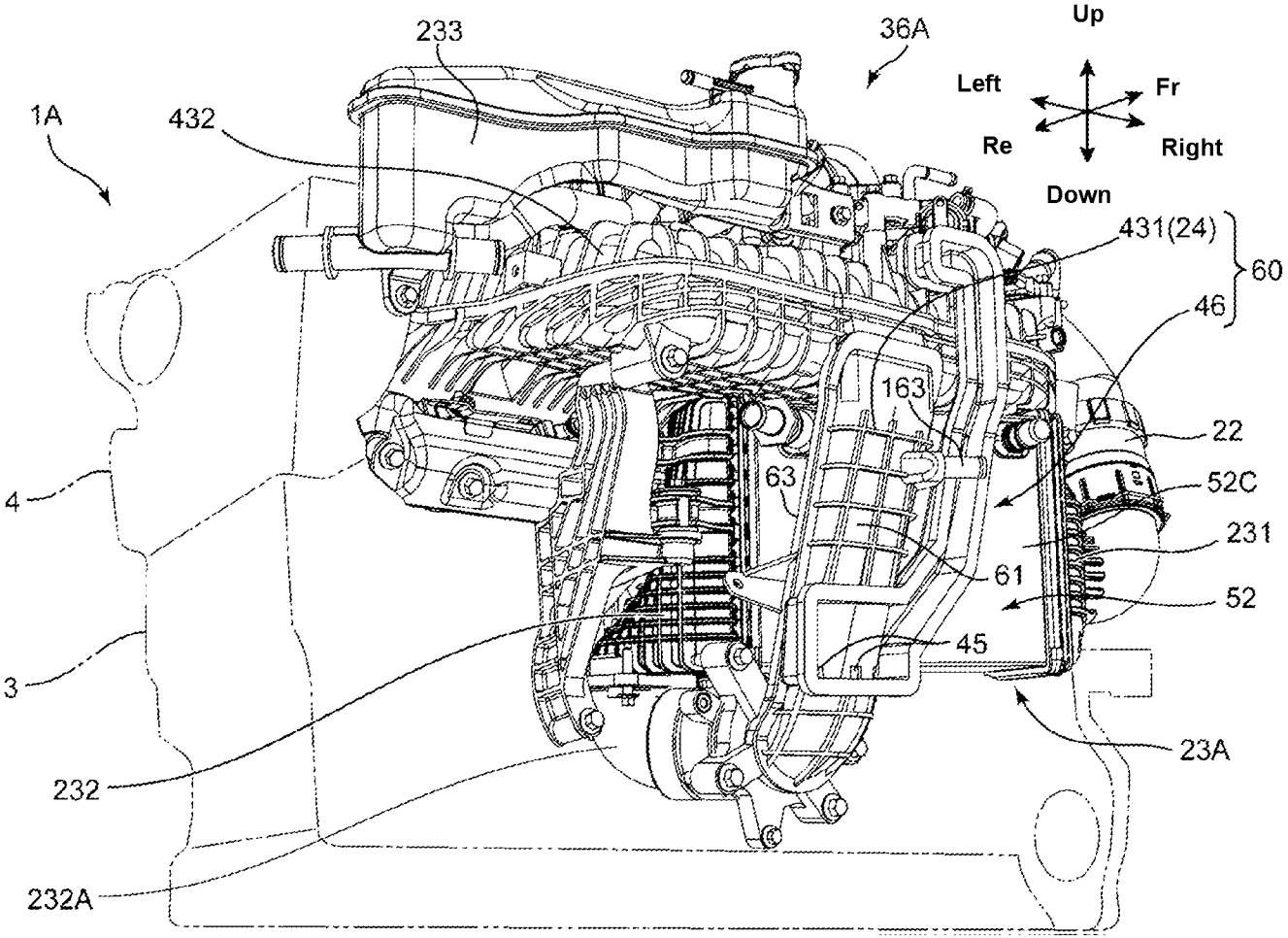
FIG. 20 is a perspective view of the intake device of the second embodiment, which shows a state where a cover member of a joining housing unit is removed.

FIG. 18 is a perspective view schematically showing an external appearance of an engine body 1A to which an intake unit 40A (intake device of the engine) according to a second embodiment of the present invention is applied. FIGS. 19 and 20 are perspective views of the engine body 1A. The engine body 1A is a six-cylinder engine with a turbocharger, for example. The intake unit 40 of the above-described first embodiment exemplifies the intercooler 23 which is configured such that the intercooler core 52 is inserted into or removed from the sealed-type chamber 51. The second embodiment exemplifies, however, an intake unit 40A provided with an intercooler 23A in which the intercooler core 52 is stored in an open-type chamber. Further, the second embodiment exemplifies a case where an arrangement manner of the EGR passage 361 relative to the downstream-side intake passage 24 and the intercooler 23A is different from that of the first embodiment.

The intercooler 23A is the water-cooling type and includes the intercooler core 52 and an upstream housing 231 and a downstream housing 232 (housings) which correspond to the chamber 51 of the first embodiment. In FIGS. 19 and 20, a sub tank 233 which is arranged above the intake manifold portion 432 is shown. The sub tank 233 is a tank to store cooling water to be supplied to the intercooler core 52.

The intercooler core 52 includes the laminated core structure comprising the water-cooling plates and the cooling fins and an outside cover 52C comprised of a rectangular-parallelopiped shaped case storing this laminated core structure. In the second embodiment, the intercooler 52 is assembled to the engine body 1A in a state where the outside cover 52C is exposed.

The upstream housing 231 is a housing which is provided upstream of the intercooler core 52 and forms an internal space which corresponds to the upstream chamber 51A of the first embodiment (see FIGS. 4 and 5). A downstream end of the upstream-side intake passage 22 is connected to the upstream housing 231. An upstream end of the outside cover 52C is provided with an engagement portion for attaching the upstream housing 231.

The downstream housing 232 is a housing which is provided downstream of the intercooler core 52 and forms an internal space which corresponds to the downstream chamber 51B of the first embodiment. A downstream end of the outside cover 52C is provided with an engagement portion for attaching the downstream housing 232. An inside space of the downstream housing 232 is connected to the vertical passage portion 431 of the downstream-side intake passage 24. A downstream end of the downstream housing 232 is provided with a connection housing 232A which interconnects an upstream end (lower end) of the vertical passage portion 431 and the above-described internal space. The connection housing 232A is a housing which forms an intake-air supply opening (not illustrated) which is similar to the intake-air supply opening 54 of the first embodiment. This intake-air supply opening has a smaller opening area than a downstream-side face of the intercooler core 52. The operational effect of the above-described intake-air supply opening provided at the connection housing 232A is similar to that of the above-described first embodiment, description of which is omitted here.

The vertical passage portion 431 of the downstream-side intake passage 24 extends upwardly along the intercooler 23A from the above-described upstream end (lower end) connected to the connection housing 232A having the above-described intake-air supply opening. While the vertical passage portion 431 is exemplified as a portion integrated with the chamber 51 in the first embodiment, the second embodiment is configured such that this vertical passage portion 431 is separated, in the longitudinal direction, from the intercooler 23A (the intercooler core 52). The intake-air manifold portion 432 is connected to the downstream end (upper end) of the vertical passage portion 431.

An EGR device 36A comprises the EGR passage 361, the EGR cooler 362, and the EGR valve 363 like the first embodiment. In the first embodiment, the EGR passage 361 positioned downstream of the EGR valve 363 is arranged so as to overlap with the front side of the vertical passage portion 431 of the downstream-side intake passage 24. However, the second embodiment exemplifies an arrangement case where a downstream EGR passage 46 which is a downstream portion of the EGR passage 361 extends in the vertical direction at a position which is offset, on the rightward side, from the vertical passage portion 431.

The downstream EGR passage 46 includes a connection passage portion 47 and a separation passage portion 48. The connection passage portion 47 is a portion which is connected to the downstream-side intake passage 24, where the EGR gas flowing through the downstream EGR passage 46 joins the intake air flowing through the downstream-side intake passage 24. The connection passage portion 47 is attached at around the lower end of the vertical passage portion 431 such that this portion 47 overlaps with the front side of the vertical passage portion 431. The separation passage portion 48 is a passage portion which is provided to extend in the vertical direction at a position which is separated, on the rightward side, from the downstream-side intake passage 24. The separation passage portion 48 has a lower-end part which is connected to the connection passage portion 47 and an upper-end part which extends up to the level (height) which is higher than the intake manifold portion 432 and is connected to the EGR valve 363.

The present embodiment exemplifies a case where the vertical passage portion 431 of the downstream-side intake passage 24 and the downstream EGR passage 46 are formed by an integrated component. That is, as shown in FIG. 19, the vertical passage portion 431 and the downstream EGR passage 46 are formed by a joining housing unit 60. This joining housing unit 60 comprises a unit body 61, a cover member 62, and an inside housing 63. FIG. 20 shows a state where the cover member 62 is removed from the joining housing unit 60.

The unit body 61 and the inside housing 63 are separated members. The inside housing 63 forms a wall face of the vertical passage portion 431 which is positioned on the side of the intercooler 23A. That is, the inside housing 63 is the member which corresponds to the inside wall part 243 of the inside housing 42 of the first embodiment. The unit body 61 is attached to the inside housing 63, whereby the internal space of the vertical passage portion 431 is formed. The inside housing 63 is the member integrated with a housing positioned on a lower side of the intake manifold portion 432.

Figure 21:
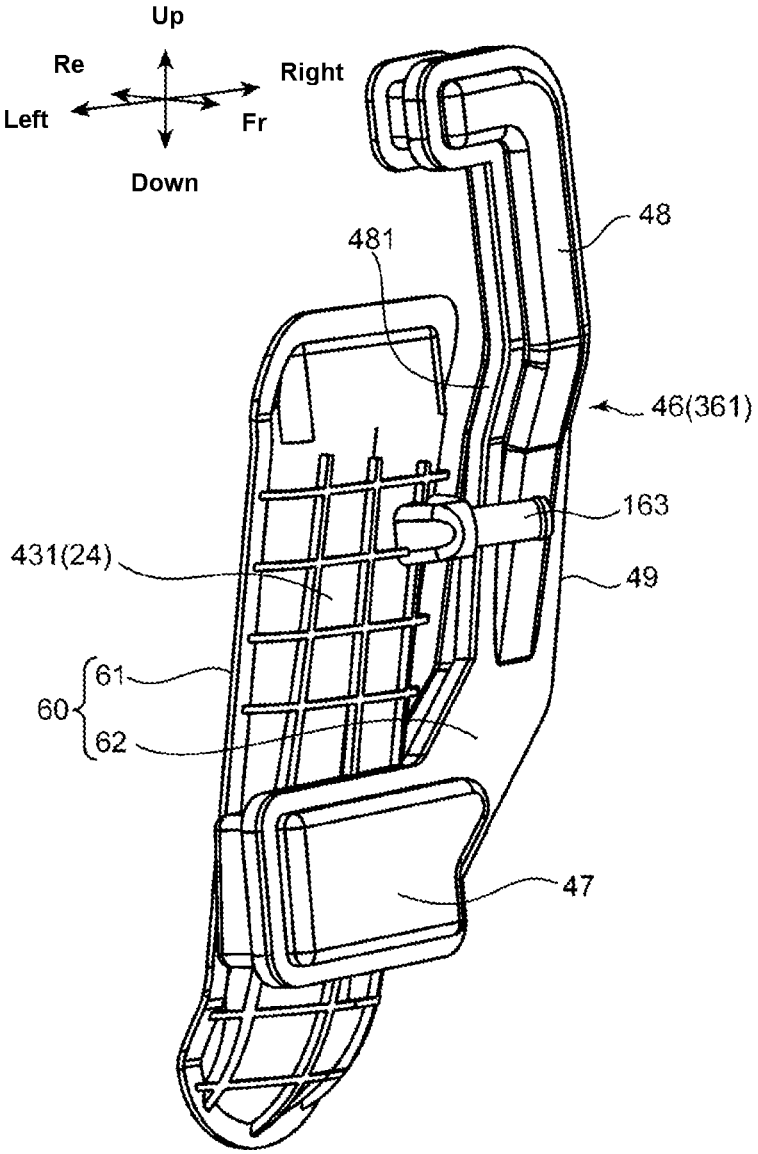
FIG. 21 is a perspective view of the joining housing unit.
Figure 22:
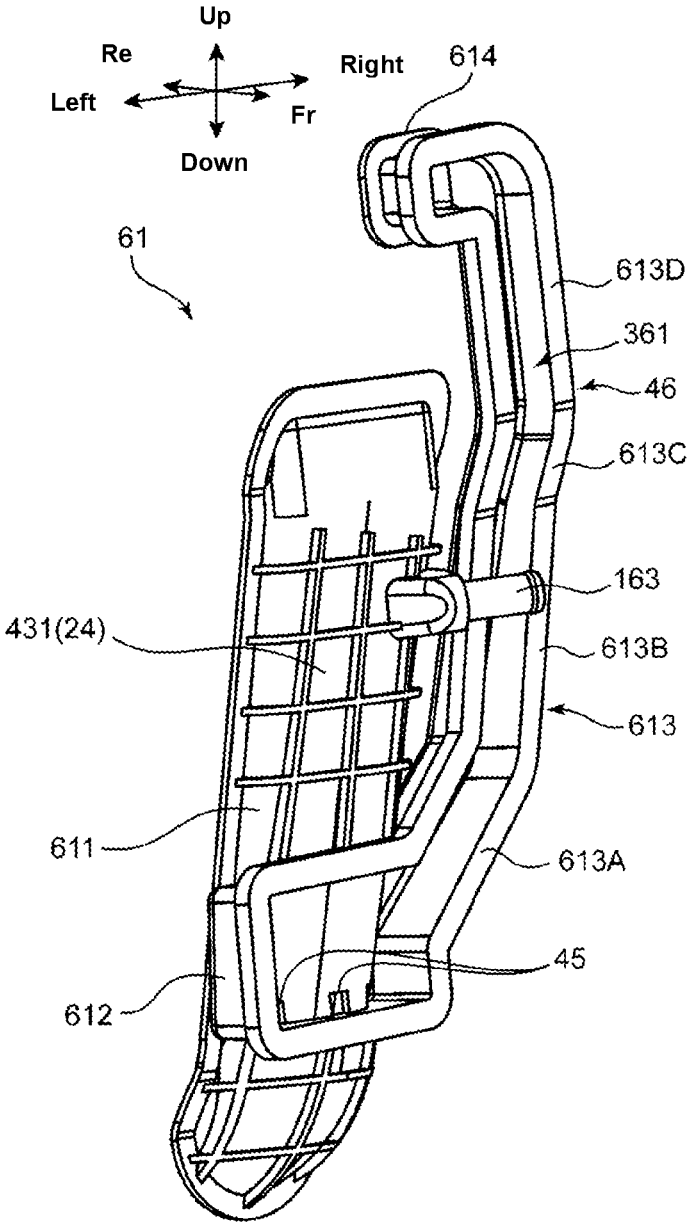
FIG. 22 is a perspective view of a unit body of the joining housing unit.
Figure 23:
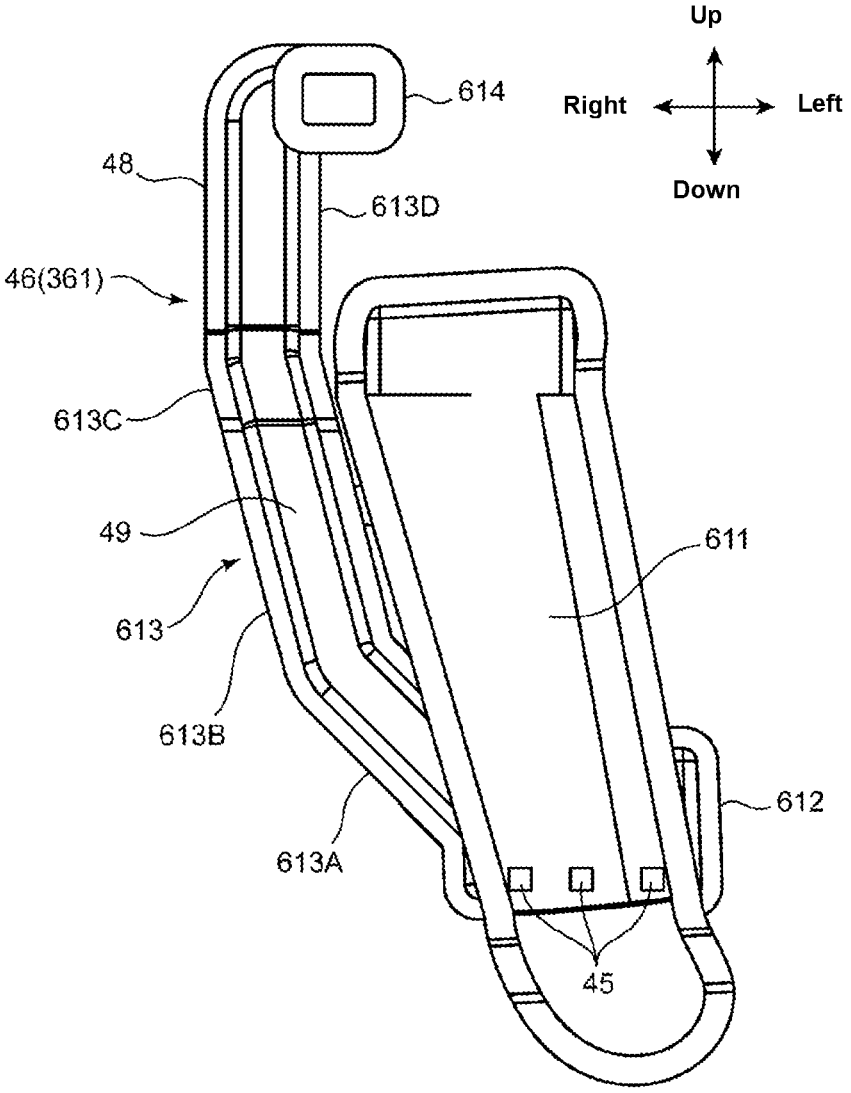
FIG. 23 is a plan view of a back-face side of the unit body.

FIG. 21 is a perspective view of the joining housing unit 60 without the inside housing 63 removed. FIG. 22 is a perspective view of the unit body 61 without the cover member 62 removed and FIG. 23 is a plan view of a back-face side of the unit body 61. The unit body 61 includes an outside wall portion 611, a joining frame portion 612, an upward extension portion 613, and a connection portion 614.

The outside wall portion 611 is a half-cylindrical portion which extends in the vertical direction and faces the inside wall part 243. The extension passage portion 242 (see FIG. 5) inside the vertical passage portion 431 is partitioned by the outside wall portion 611 and the inside wall part 243. The blow-by introduction port 163 is provided near an upper end of the outside wall portion 611.

The joining frame portion 612 is a rectangular-parallelopiped shaped frame body which projects forwardly near at a forward-lower part of the outside wall portion 611. An opening of the joining frame portion 612 is covered with a lower end portion of the cover member 62, whereby the above-described connection passage portion 47 is formed. The EGR introduction ports 45 to introduce the EGR gas into the vertical passage portion 431 are provided at the outside wall portion 611 in an area enclosed by the joining frame portion 612. The present embodiment exemplifies a structure in which the three EGR introduction ports 45 are formed in a peripheral direction of the outside wall portion 611. Of course, the EGR introduction ports 45 may be arranged similarly to the first embodiment.

The upward extension portion 613 is a portion which forms the above-described separation passage portion 48, which is a passage to direct the EGR gas toward the EGR introduction ports 45. The upward extension portion 613 extends obliquely upwardly-and-rightwardly from the joining frame portion 612 in a Y-shaped forked manner relative to the outside wall portion 611. That is, the upward extension portion 613 directly faces the intercooler core 52 so that the heat exchanging can be achieved by using a space formed therebetween. The upward extension portion 613 includes a first part 613A, a second part 613B, a third part 613C (curved part) and a fourth part 613D, which are arranged in order from its lower side to its upper side (see FIGS. 22 and 23).

The first part 613A extends obliquely upwardly-and-rightwardly from a right side wall of the joining frame portion 612. The second part 613B extends upwardly from an upper end of the first part 613A. The second part 613B and the outside wall portion 611 extend in the vertical direction nearly in parallel to each other. The third part 613C is curved obliquely forwardly from an upper end of the second part 613B. The fourth part 613D extends upwardly from an upper end of the third part 613C and reaches the connection portion 614. The fourth part 613D is provided to project forwardly so as to pass through around the intake manifold portion 432 projecting forwardly (see FIG. 19). The connection portion 614 is arranged above the intake manifold portion 432, and interconnects an outlet side of the EGR valve 363 and the upward extension portion 613.

The third part 613C is a curved portion which is configured to be curved rearwardly from the fourth part 613D passing through around the intake manifold 432 and approach the intercooler core 52, when viewed in the flowing direction of the EGR gas. The second part 613B connected to a lower end of the third part 613C is a portion which is formed by the above-described curved portion and extends in the vertical direction, approaching the intercooler core 52. That is, the second part 613B is the portion which is located at the level facing the intercooler core 52, and a rear face of the second part 613B approaches the intercooler core 52 the most among the parts 613A-D. In the present embodiment, the rear face of the second part 613B becomes a heat reception part 49 which receives heat generated by the intercooler core 52.

Figure 24:
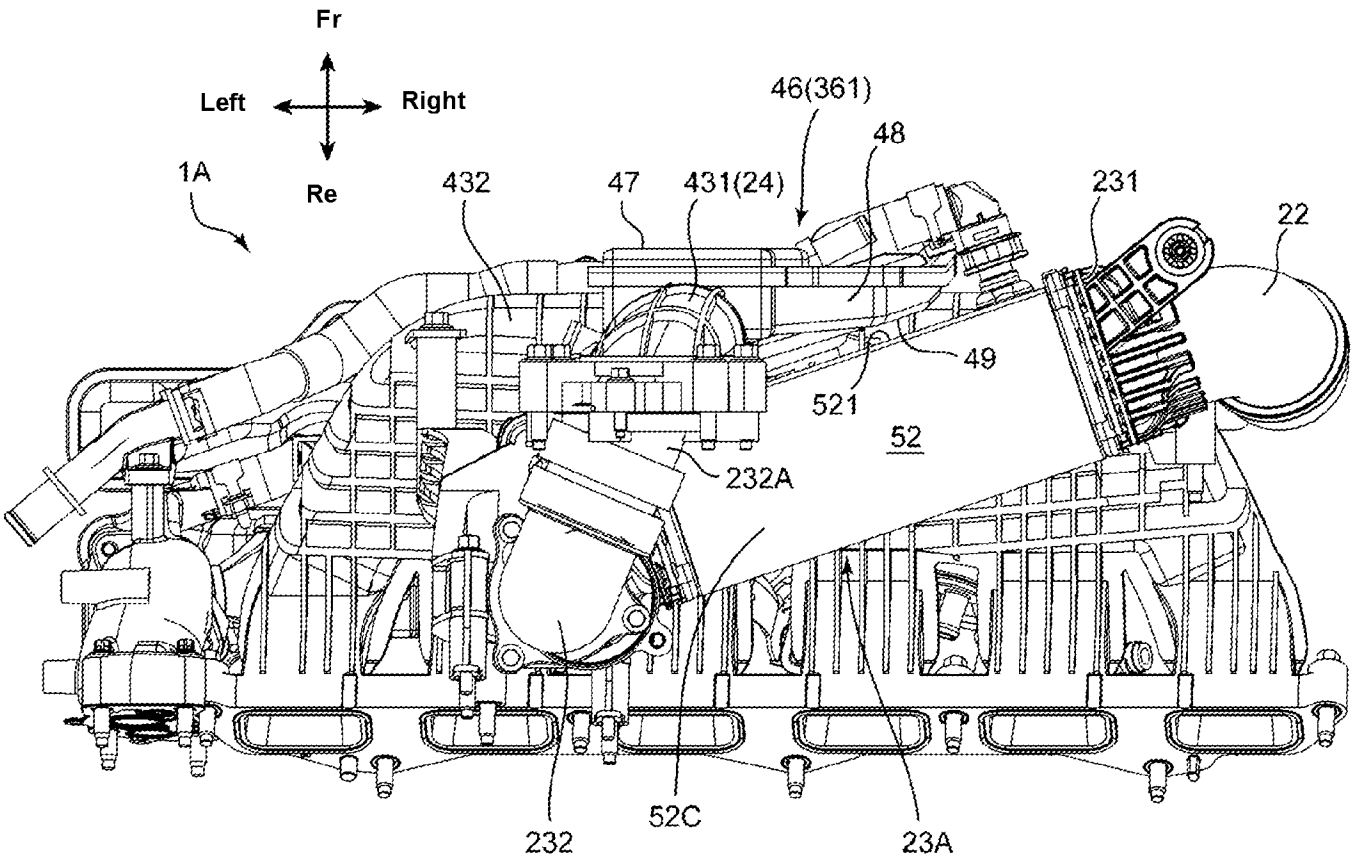
FIG. 24 is a bottom view of the intake device of the second embodiment.
Figure 25:
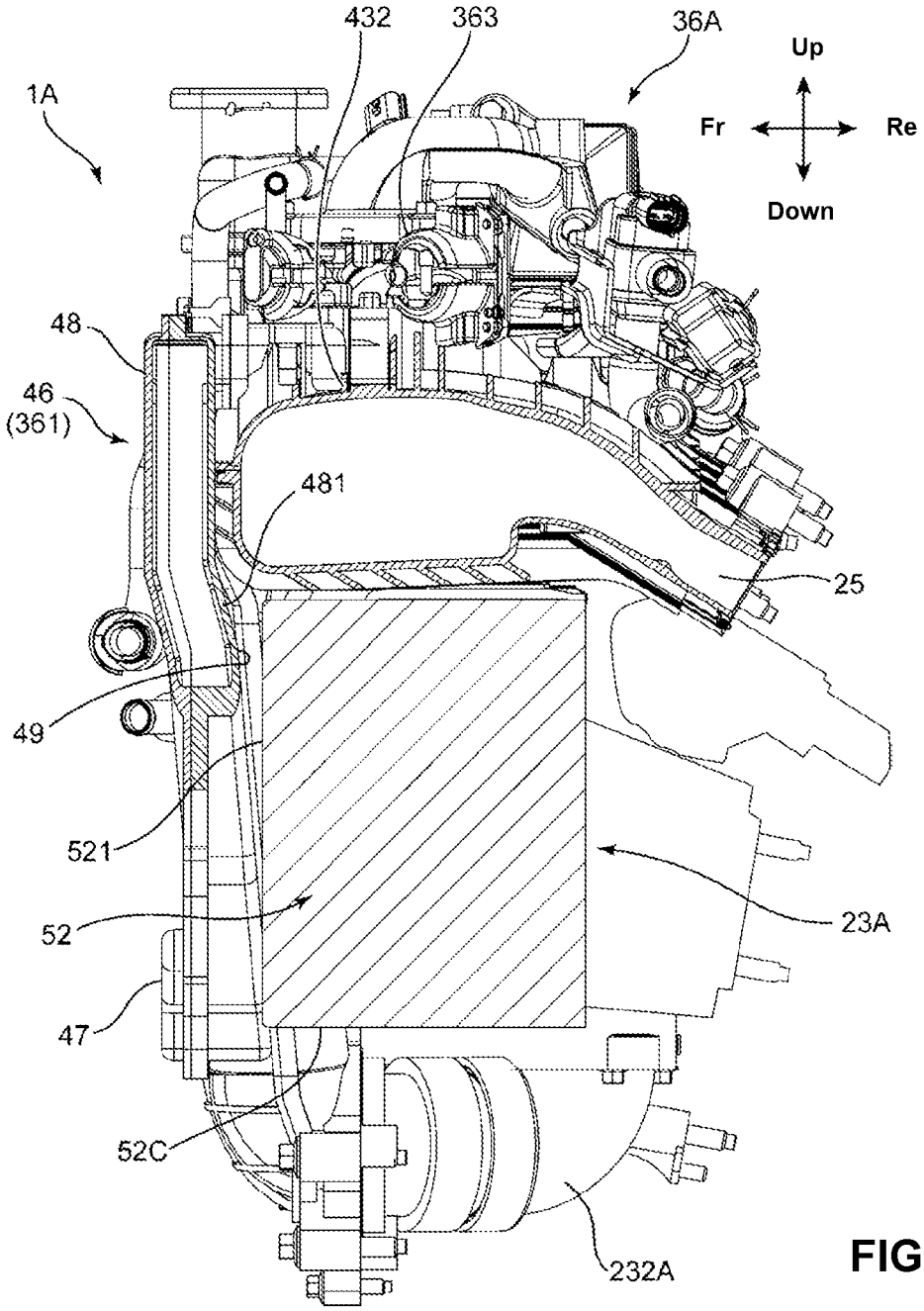
FIG. 25 is a sectional view taken along line XXV-XXV of FIG. 18.

Referring to FIGS. 24 and 25, positional relationships between the intercooler core 52 and the separation passage portion 48 will be described. FIG. 24 is a bottom view of the intake unit 40A of the second embodiment. FIG. 25 is a sectional view taken along line XXV-XXV of FIG. 18. As shown in FIG. 24, the intercooler 52 is provided to is inclined relative to the lateral direction of the engine body 1A. Specifically, the intercooler core 52 is arranged relative to the engine body 1A such that its section positioned on the side of the upstream housing 231 is directed forwardly and its section positioned on the side of the downstream housing 232 is directed rearwardly.

The separation passage portion 48 of the downstream EGR passage 46 is arranged on the forward side of a front-side face 521 of the intercooler core 52 with a short distance. A position where the separation passage portion 48 faces the front-side face 521 is upstream, in the intake-air flowing direction, of the intercooler core 52. Meanwhile, the connection passage portion 47 and the vertical passage portion 431 face the downstream side of the intercooler core 52.

The above-described heat reception part 49 is a facing face of the separation passage portion 48 which faces an upstream side of the front-side face 521. In other words, the intercooler core 52 is arranged such that the upstream side, in the intake-air flowing direction, of the intercooler core 52 approaches the separation passage portion 48. A distance between the heat reception part 49 and the front-side face 521 is set at a proper distance such that the heat (radiant heat) radiated from the front-side face 521 is received at the heat reception part 49 and the EGR gas flowing through the separation passage portion 48 is heated. For example, the above-described distance can be selected from a range of about 2 mm-4-mm.

In a sectional (cross section in the vertical direction) view of FIG. 25, the heat reception part 49 is formed by a curved portion 481 which is configured such that a part of the separation passage portion 48 is curved so as to approach (be close to) the intercooler core 52. The curved portion 481 is a portion corresponding to the third part 613C shown in FIGS. 22 and 23. If the curved portion 481 was not formed, that is, the separation passage portion 48 was configured to extend right downwardly from a portion (the fourth part 613D) which avoided interference with the intake manifold portion 432, the reception part 49 would be separated from the front-side face 521 of the intercooler core 52 with a relatively long distance. However, in the present embodiment, the heat reception part 49 can be arranged closely to the front-side face 521 by forming the curved portion 481.

The above-described intake unit 40A of the second embodiment has the advantage (merit) based on the intake-air supply opening 54 which has been specifically described in the first embodiment. Additionally, the intake unit 40A can heat the EGR gas passing through the separation passage portion 48 (the EGR passage 361) by the heat reception part 49 receiving the heat generated by the intercooler core 52.

There is a case where a large amount of condensed water is generated if the EGR gas is introduced into the downstream-side intake passage 24 in a state where the EGR gas is excessively cooled by the EGR cooler 362. It is necessary for the EGR cooler 362 to have the capability of cooling the EGR gas sufficiently in a high-load driving condition. Accordingly, in a middle/light-load driving condition or the like, the EGR gas can be cooled to a certain degree enough to generate the large amount of condensed water (about 100° C., for example). Meanwhile, the intake air flowing into the intercooler core 52 from the upstream-side intake passage 22 is supercharged by the turbocharger 15 (FIG. 1), so that this intake air becomes the higher temperature than the cooled EGR gas. That is, the portion positioned upstream of the intercooler core 52, specifically the intercooler core 52 in a state where the intake air has not been cooled yet, has a considerably-higher temperature than the separation passage portion 48.

In the second embodiment, since the heat reception part 49 receives the heat generated by the intercooler core 52, the EGR gas can be heated through the heat reception part 49. Since the heated EGR gas is introduced into the downstream-side intake passage 24, a temperature difference between the intake air and the EGR gas becomes small, so that the condense water can be suppressed from being generated.

Further, the heat reception part 49 is formed by the curved portion 481 configured such that a part of the separation passage portion 48 is curved so as to approach (be close to)

the intercooler core 52. Thereby, a portion of the separation passage portion 48 which is close to the intercooler core 52, that is, the heat reception part 49 which receives the heat from the intercooler core 52, can be easily structured by forming the curved portion 481.

Further, the intercooler core 52 is arranged such that the upstream side, in the flowing direction of the intake air, thereof approaches the separation passage portion 48. The heat reception portion 49 is configured to be a portion which faces the above-described upstream side of the intercooler core 52. Since this upstream side of the intercooler core 52 is the portion where the heated intake air is introduced, the temperature of this place becomes relatively high. By making the heat reception part 49 approach the upstream side of the intercooler core 52, a large amount of heat can be given to the heat reception part 49. Accordingly, the EGR gas can be efficiently heated.

MODIFICATIONS

While the first and second embodiments have been described, the present invention is not limited to these, but the following modifications can be applied, for example.

(1) The above-described embodiments describe the intake-air supply opening 54 having the semicircular-shaped cross section in which the upper edge portion 541 is the straight edge portion. Various kinds of modification of the upper edge portion 541 can be applied as long as the intake air is separated from the inside wall part 243 of the extension passage portion 242 and the main streams R1, R2 of the intake air is generated inside the extension passage portion 242.

Figure 16A:
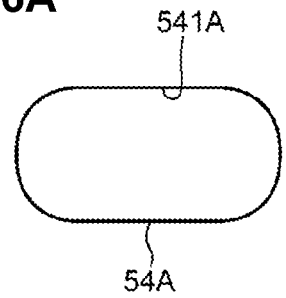
FIGS. 16A-16D are diagrams showing modifications of an intake-air supply opening.
Figure 16B:
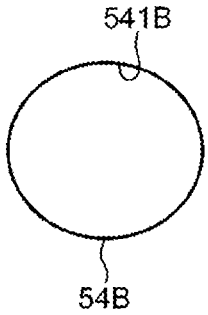
Figure 16C:
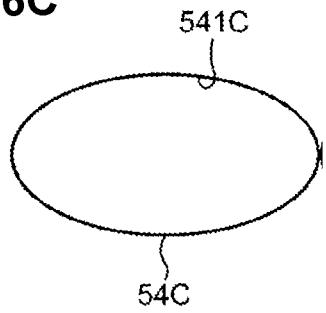
Figure 16D:
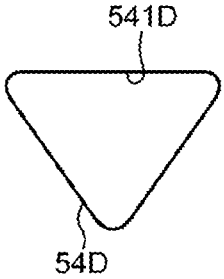

FIGS. 16A-16D are diagrams showing modifications of the intake-air supply opening 54. An intake-air supply opening 54A shown in FIG. 16A is of a square shape in which a corner portion is curved, and an upper edge portion 541A of that is straight. An intake-air supply opening 54B shown in FIG. 16B is of an oval shape in which a ratio of a short axis (vertical axis) and a long axis (lateral axis) is relatively small, and an upper edge portion 541B is formed by a convex curved line which projects upwardly. An intake-air supply opening 54C shown in FIG. 16C is of an oval shape in which a ratio of a short axis and a long axis is relatively large, and an upper edge portion 541C is formed by a convex curved line which slightly projects upwardly. An intake-air supply opening 54D shown in FIG. 16D is of a triangular shape in which an upper edge portion 541D is straight. These intake-air supply openings 54A-54D can achieve the intake-air flowing separated from the inside wall part 243 and the generation of the main streams R1, R2 of the intake air as well.

Figure 17:
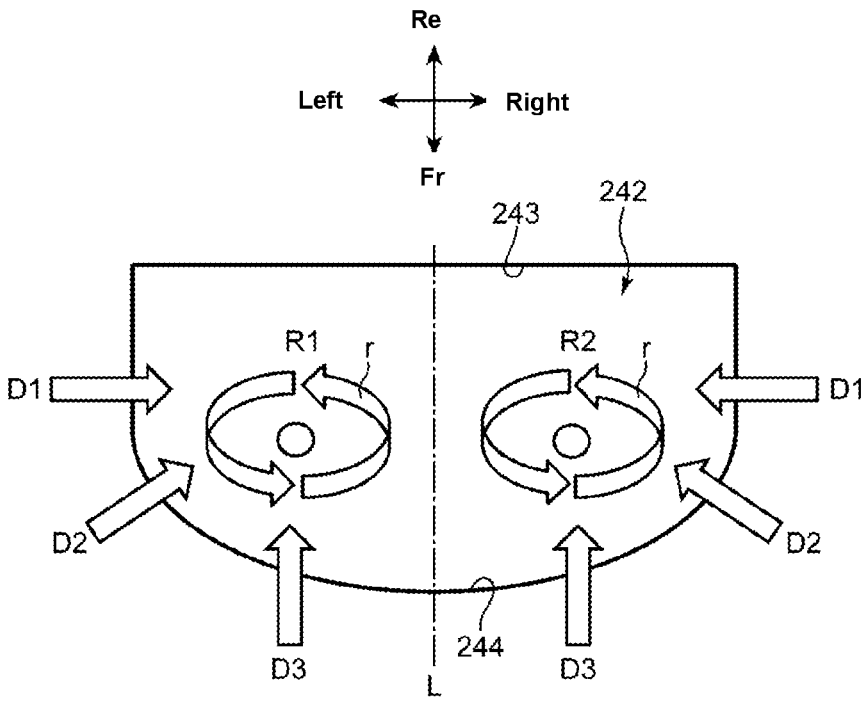
FIG. 17 is a diagram showing a modification of an arrangement position of an EGR introduction port.

(2) The arrangement position of the EGR introduction ports 45 are not limited as long as the EGR gases F1, F2 can be discharged (supplied) toward the flowing main streams R1, R2 of the intake air. FIG. 17 is a schematic sectional diagram of the extension passage portion 242, which shows various arrangement examples of the EGR introduction port 45. Arrows D1, D2 and D3 shown in FIG. 17 show introduction directions of the EGR gas to the extension passage portion 242, i.e., the arrangement positions of the EGR introduction port 45.

The introduction direction of the arrow D1 is the arrangement position of the EGR introduction port 45 of the above-described embodiment shown in FIG. 15 and others. As descried above, if the EGR introduction port 45 is arranged at the position of the arrow D1, the EGR gas can be made to hit against the flowing main streams R1, R2 of the intake air with the secondary flows r. The introduction direction of the arrow D2 is closer to a center line L, in the width direction (lateral direction), of the extension passage portion 242 (the outside wall part 244) than that of the arrow D1. The introduction direction of the arrow D3 is further closer to the center line L than that of the arrow D2. Even if the EGR introduction port 45 is arranged at the position of the arrow D2, D3, the EGR gas can be made to hit against the flowing main streams R1, R2 of the intake air, so that the EGR gas can be maxed with intake air properly.

In other words, the arrangement position of the EGR introduction port 45 is preferably located in an area except the center line L, in the width direction, of the outside wall part 244 and the vicinity thereof. Herein since there is a tendency that the flowing main streams R1, R2 do not face each other in an area near the inside wall part 243, it is preferable that this area be avoided. The main streams R1, R2 of the intake air with the secondary flows r are generated, being separated from each other, in the width direction, inside the extension passage portion 242. Accordingly, the EGR gas can be made to hit against the flowing main streams R1, R2 securely by arranging the EGR introduction port 45 in the area except the center line L and its vicinity.

(3) The above-described embodiments show the example where the intake device according to the present invention is applied to the multi-cylinder gasoline engine with the turbocharger. The intake device of the present invention is applicable to a diesel engine and an engine which is not provided with the turbocharger 15 as well.

(4) The second embodiment shows the example where the upstream housing 231 and the downstream housing 232 are respectively attached upstream and downstream of the intercooler core 52 as the chamber storing the intercooler core 52. However, the sealed type of chamber where the intercooler core 52 can be inserted into or removed from like the chamber 51 exemplified in the first embodiment is applicable in the second embodiment.

What is claimed is:

1. An intake device of an engine, comprising:

an intercooler including a chamber and an intercooler core stored inside the chamber;

an intake passage including a downstream-side intake passage positioned downstream of the chamber of the intercooler and provided to introduce intake air into an engine body through the chamber; and an EGR passage provided to recirculate a part of exhaust gas exhausted from the engine body to the downstream-side intake passage of the intake passage as EGR gas, wherein said chamber includes a side wall provided with an intake-air supply opening which has an opening area which is smaller than an area of a downstream-side face of said intercooler core, said downstream-side intake passage includes an upstream end which is connected to said intake-air supply opening and an extension passage portion which extends upwardly from the upstream end along the side wall of said chamber, the extension passage portion being partitioned by a wall which includes an inside wall part positioned on a side of the chamber and an outside wall part facing the inside wall part, an opening edge which partitions said intake-air supply opening includes an upper edge portion which is configured to separate the intake air flowing from said chamber into said extension passage portion from said inside wall part and to form a main stream of flowing of the intake air inside the extension passage portion, said outside wall part of the extension passage portion includes an EGR introduction port to join said EGR passage to said downstream-side intake passage, the EGR introduction port being arranged at a position capable of supplying said EGR gas toward said main stream of flowing of the intake air, and said EGR passage includes a connected passage portion which is connected to said downstream-side intake passage and a separated passage portion which is arranged at a position separated from said downstream-side intake passage, and said separated passage portion is provided with a heat reception part which receives heat generated by said intercooler core.

2. The intake device of the engine of claim 1, wherein said opening edge of the intake-air supply opening comprises a straight edge portion which corresponds to said upper edge portion and a semicircular edge portion which is positioned below the straight edge portion.

3. The intake device of the engine of claim 2, wherein an upstream part of said extension passage portion which is continuous to said upstream end is a curved passage which is configured to be curved upwardly, the upstream part being of a semicircular shape, in a sectional view, similarly to said intake-air supply opening.

4. The intake device of the engine of claim 3, wherein said intake-air supply opening is arranged in a lower-end area of said chamber.

5. The intake device of the engine of claim 4, wherein said EGR introduction port is arranged in a lower-end area of said extension passage portion.

6. The intake device of the engine of claim 5, wherein said EGR introduction port is arranged in an area except a center line, in a width direction, of said outside wall part and the vicinity thereof.

7. The intake device of the engine of claim 6, wherein said EGR passage extends in a vertical direction along said outside wall part and has a forked downstream end where a lower end thereof forks, and said EGR introduction port is arranged at each of forked parts of said forked downstream end of the EGR passage.

8. The intake device of the engine of claim 6, wherein a sectional area of said EGR passage is set to be smaller than that of said extension passage portion.

9. The intake device of the engine of claim 1, wherein said heat reception part is formed by a curved portion of a part of said separated passage portion which is configured to be curved toward said intercooler core.

10. The intake device of the engine of claim 1, wherein said intercooler core is arranged such that an upstream side, in a flowing direction of the intake air, thereof approaches said separated passage portion, and said heat reception part is a portion of the separated passage portion which faces said upstream side of the intercooler core.

11. The intake device of the engine of claim 1, wherein said intake-air supply opening is arranged in a lower-end area of said chamber.

12. The intake device of the engine of claim 1, wherein said EGR introduction port is arranged in an area except a center line, in a width direction, of said outside wall part and the vicinity thereof.

13. The intake device of the engine of claim 11, wherein said EGR introduction port is arranged in a lower-end area of said extension passage portion.

14. The intake device of the engine of claim 12, wherein said EGR passage extends in a vertical direction along said outside wall part and has a forked downstream end where a lower end thereof forks, and said EGR introduction port is arranged at each of forked parts of said forked downstream end of the EGR passage.

15. The intake device of the engine of claim 12, wherein a sectional area of said EGR passage is set to be smaller than that of said extension passage portion.

16. An intake device of an engine, comprising:

an intercooler including an intercooler core;

an intake passage including a downstream-side intake passage positioned downstream of the intercooler and provided to introduce intake air into an engine body through the intercooler;

an EGR passage provided to recirculate a part of exhaust gas exhausted from the engine body to the downstream-side intake passage of the intake passage as EGR gas; and a housing provided with an intake-air supply opening which has an opening area which is smaller than an area of a downstream-side face of the intercooler core, wherein said downstream-side intake passage includes an upstream end which is connected to said intake-air supply opening and an extension passage portion which extends upwardly from the upstream end along said intercooler, the extension passage portion being partitioned by a wall which includes an inside wall part positioned on a side of the intercooler and an outside wall part facing the inside wall part, an opening edge which partitions said intake-air supply opening includes an upper edge portion which is configured to separate the intake air flowing from said intercooler core into said extension passage portion from said inside wall part and to form a main stream of flowing of the intake air inside the extension passage portion, said outside wall part of the extension passage portion includes an EGR introduction port to join said EGR passage to said downstream-side intake passage, the EGR introduction port being arranged at a position capable of supplying said EGR gas toward said main stream of flowing of the intake air, and said EGR passage includes a connected passage portion which is connected to said downstream-side intake passage and a separated passage portion which is arranged at a position separated from said downstream-side intake passage, and said separated passage portion is provided with a heat reception part which receives heat generated by said intercooler core.

17. The intake device of the engine of claim 16, wherein said heat reception part is formed by a curved portion of a part of said separated passage portion which is configured to be curved toward said intercooler core.

18. The intake device of the engine of claim 16, wherein said intercooler core is arranged such that an upstream side, in a flowing direction of the intake air, thereof approaches said separated passage portion, and said heat reception part is a portion of the separated passage portion which faces said upstream side of the intercooler core.

* * * * *